United States Patent [19]

Kucher

[11] 4,106,754

[45] Aug. 15, 1978

[54] CABLE HAULING WINCH

[76] Inventor: Robert C. Kucher, 5200 Airport Way South, Seattle, Wash. 98108

[21] Appl. No.: 741,995

[22] Filed: Nov. 15, 1976

Related U.S. Application Data

[63] Continuation-in-part of Ser. No. 349,540, Apr. 9, 1973, abandoned, and a continuation-in-part of Ser. No. 349,564, Apr. 9, 1973, abandoned.

[51] Int. Cl.[2] ..... B66D 1/00

[52] U.S. Cl. ..... 254/186 HC; 114/251; 74/577 R

[58] Field of Search ..... 254/186 R, 186 HC, 167, 254/150 R, 175.7, DIG. 14; 114/251, 218; 248/119 R, 25; 74/575, 577 R, 578; 24/134 KB, 134 R

[56] References Cited

U.S. PATENT DOCUMENTS

| | | | |
|---|---|---|---|
| 3,141,353 | 7/1964 | Gray | 74/577 |
| 3,756,184 | 9/1973 | Hutto | 114/251 |
| 3,796,404 | 3/1974 | Shields | 248/119 R |

*Primary Examiner*—Trygve M. Blix
*Assistant Examiner*—Kenneth Noland
*Attorney, Agent, or Firm*—Thomas W. Secrest

[57] ABSTRACT

This invention is for a winch having a drum for receiving a line. There are two species of the winch. In the first specie, the winch comprises a drum gear and a drum ratchet. There is a driving means for driving the drum gear and the drum. Also, there is a locking means cooperating with the drum ratchet for preventing the rotation of the drum and the unwinding of the line from the drum. In the second specie, the winch comprises a drum gear and means for driving the drum gear and the drum. Also, there are means for preventing rotation of the drum and the unwinding of the line off of the drum.

26 Claims, 51 Drawing Figures

CABLE HAULING WINCH

This patent application is a continuation-in-part of two copending patent applications. One of these patent application is Ser. No. 349,540, now abandoned, filing date of Apr. 9, 1973, entitled WINCH. The other one of these patent applications is Ser. No. 349,564, now abandoned, filing date of Apr. 9, 1973, entitled WINCH.

THE GENERAL BACKGROUND OF THE INVENTION

The use of barges or lighters to transport cargo is common in marine transportation. Barges may be used singly or in groups. The groups may be referred to as barge trains. A barge or a barge train may be towed by a tug boat or a powered vessel or pulled by other suitable means.

Barges are, commonly, rectangular in shape with a straight or square bow, although very large barges, particularly, those used in deep sea voyages or on the open ocean may have a shaped bow for better sea-keeping characteristics than a barge with a square bow.

The barges in a barge train carrying goods in harbors and along rivers are, usually, lashed tightly together, two or three abreast, with several successive rows of such barges in one barge train. Such barge trains are, usually, pushed by the tug boat, rather than being pulled by the tug boat.

In recent years a new method of using barges has been developed. A number of barges are loaded with cargo at various upriver ports or in various parts of a harbor. A barge train is then formed by securing together a mumber of barges. The barge train is then towed to an ocean-going ship lying in a harbor. The barge train is broken up and the barges are, individually, lifted aboard the ocean-going ship. Aboard ship, the barges are again lashed to each other to prevent damage caused by movement of the carrying ship on the open sea. When the ocean-going ship arrives at its destination, the barges are unlashed from each other, and placed into the water. New barge trains are then formed for river destinations or inland waterway destinations or harbor destinations. Making up the barge trains anew requires that the barges be lashed together again, although, generally, in a different grouping than when the barges were first loaded with their cargoes.

It is obvious that any given barge will be lashed to another barge on frequent occasions. Because of the large number of barges involved in any given operation, sometimes one hundred or more barges being aboard one ship, the lashing and unlashing procedure must be, rapidly, accomplished. Further, because of the weight of the barges, and the potential for damage should a barge lashing fail, the lashing must be extremely sturdy, with an unusually high factor of safety, as well as including safeguards against failure. There is also an essential requirement that the lashing equipment be low in cost, as well as having the other attributes described above. In order that barges achieve their maximum utility, it is necessary that they be capable of being placed anywhere in the barge train. Since each barge has four sides and, therefore has four corners, it is necessary that four sets of lashing equipment be mounted on each barge, one at each corner. Low-cost lashing equipment makes a more-than-customary contribution to the economic feasibility of this transportation system.

THE GENERAL DESCRIPTION OF THE INVENTION

There is disclosed herein a winch capable of taking and holding a strain on a cable. A hand-rocked pawl and ratchet turns a pinion gear which in turn drives a drive gear fixed to the winch drum. The pawl-and-ratchet system turns the drum in a direction to take a strain upon a cable fixed to the drum. The drum may contain a large ratchet wheel, which can be locked against cableunwinding rotation by a separate hand-operated locking mechanism. Another feature of the invention is a separately mounted cable fastener which will serve to hold a cable in place against tension. On the winch itself, a third gear and a hand wheel are provided so that the winch drum nay be turned rapidly for taking up slack in a cable.

There is also disclosed herein a winch capable of taking and holding a strain on a cable. A hand-rocked pawl and ratchet turns a pinion gear which in turn drives a drive gear or drum gear fixed to the winch drum. The pawl-and-ratchet system turns the drum in a direction to take a strain upon a cable fixed to the drum. There is a separate hand-operated locking mechanism for cooperation with the drum gear to prevent the unwinding of the cable. Another feature of the invention is a separately mounted cable fastener which will serve to hold a cable in place against tension. On the winch itself, a third gear and a hand wheel are provided so that the winch drum may be turned rapidly for taking up slack in a cable.

THE OBJECTS AND THE ADVANTAGES

From the foregoing discussion of the invention and the use of the invention, it is an object of this invention to provide lashing equipment that can quickly take up slack and place a strain on a rope or a cable or a line, that can be manufactured at a low cost; a further object is to provide a winch which is straightforward in construction and which will withstand hard use; it is a further object to provide a lash winch that can be operated solely by hand during all phases of a barge lashing operation, including the final tensioning where the greatest strain is placed on the securing line; another important object is to provide a winch that can be rotated about its mounting to allow for leading the cable in any direction from the barge or from the mount, and that will also allow the winch to pivot vertically to some degree, or, in other words, can be rotated, horizontally, through any angle and also rotated, vertically; an additional object is to provide a cable fastener in which a cable may be laid for a quick and reliable securing and yet, which can be released, easily, and, quickly.

The above and other objects and advantages of the invention will become more apparent upon consideration of the following detailed description of the invention, the accompanying drawings, and the appended claims:

THE DRAWINGS

Figure 33:
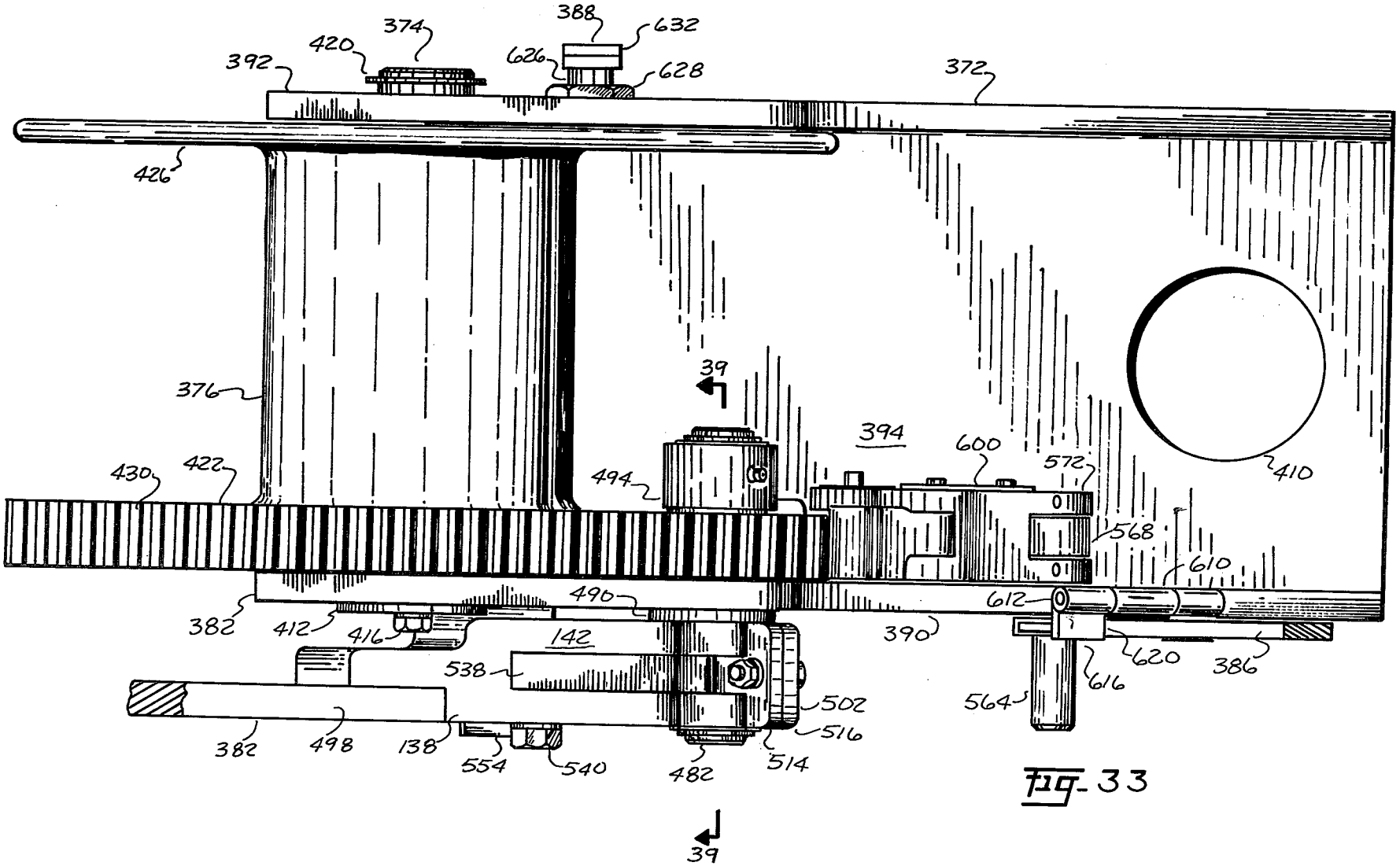
FIG. 33 is a plan view of the winch of FIG. 32.
Figure 36:
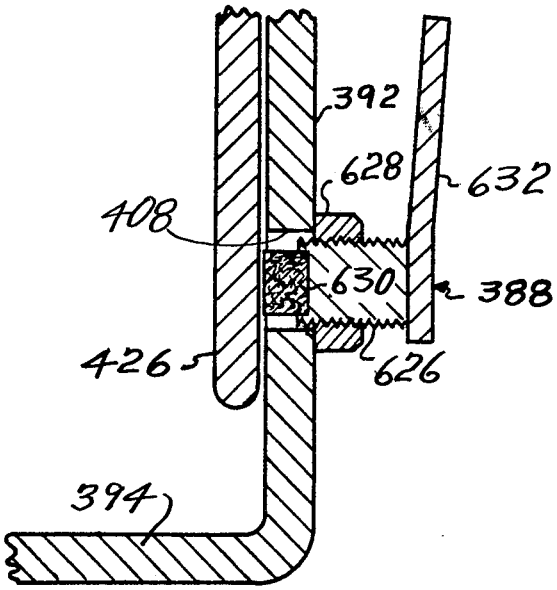
Figure 37:
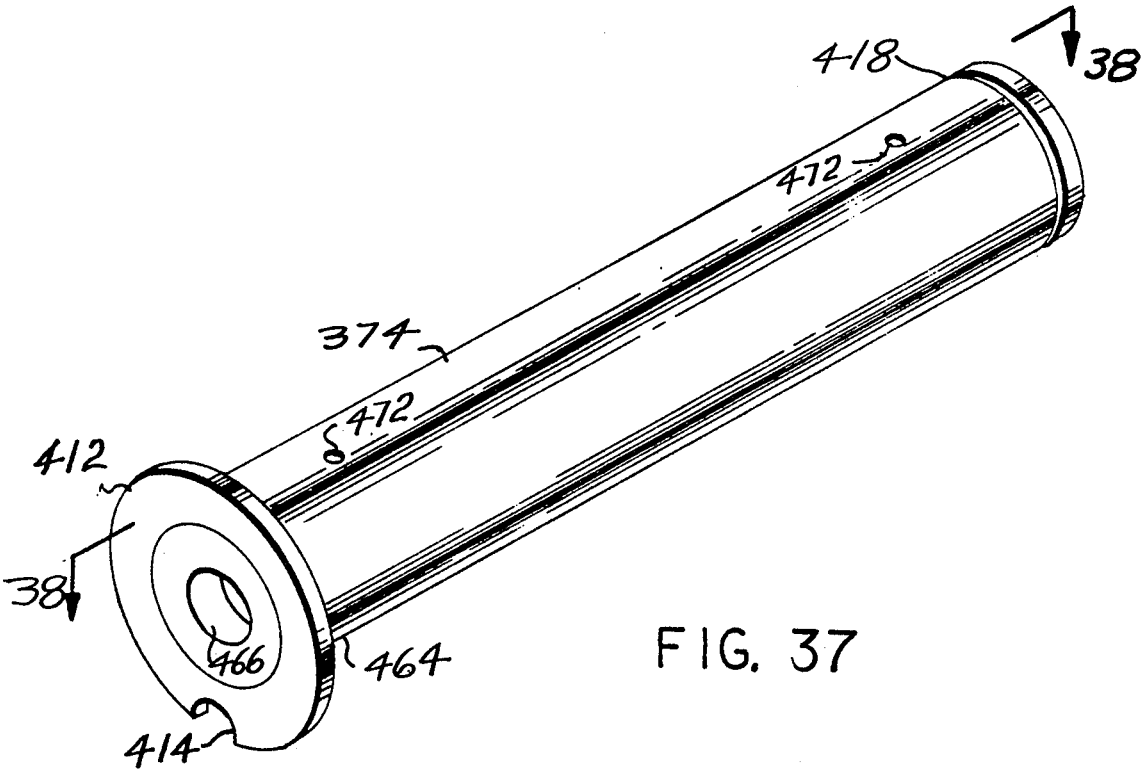
Figure 38:
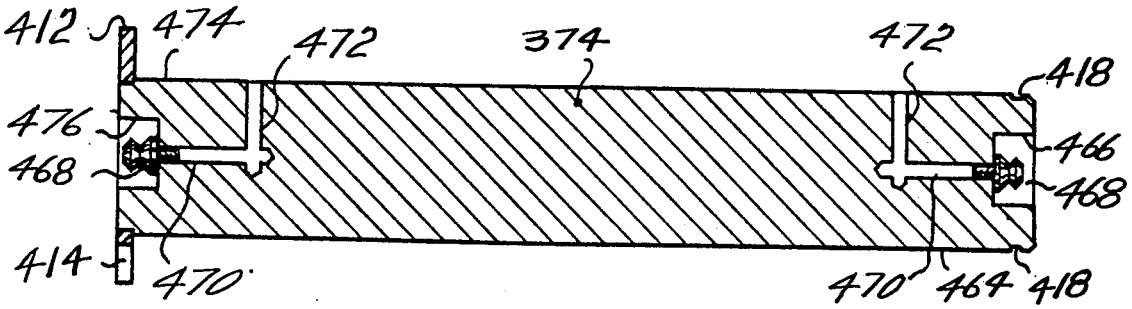
Figure 39:
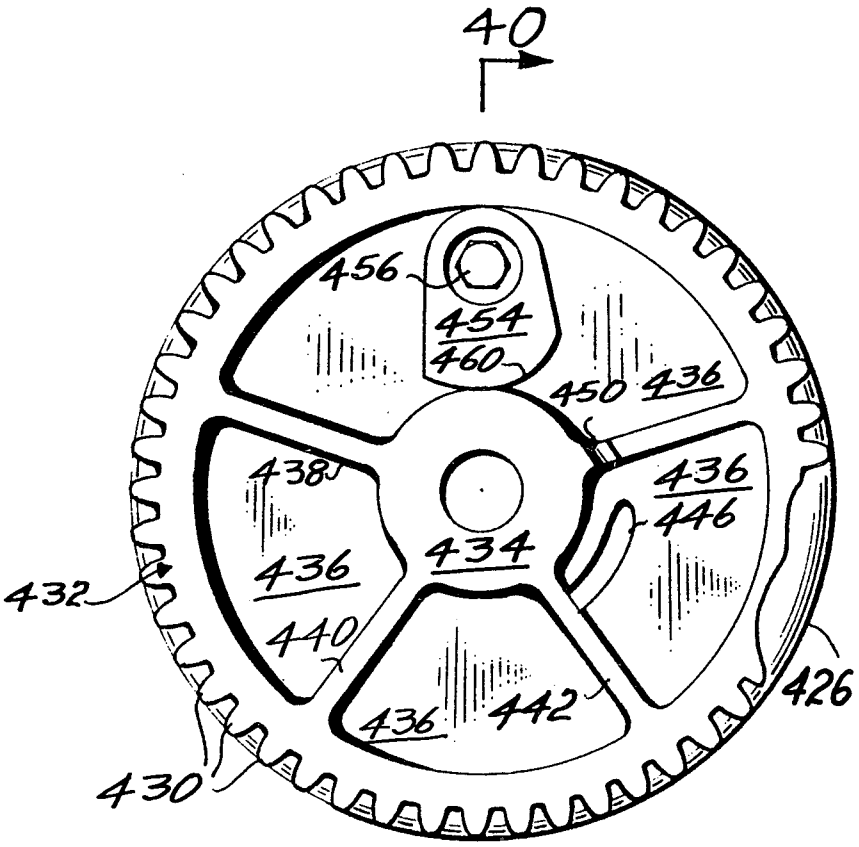
Figure 40:
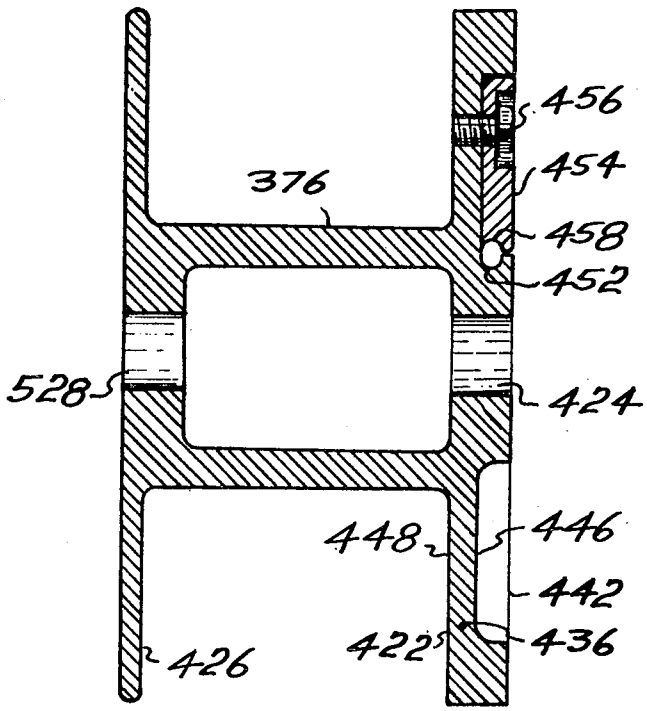
Figure 41:
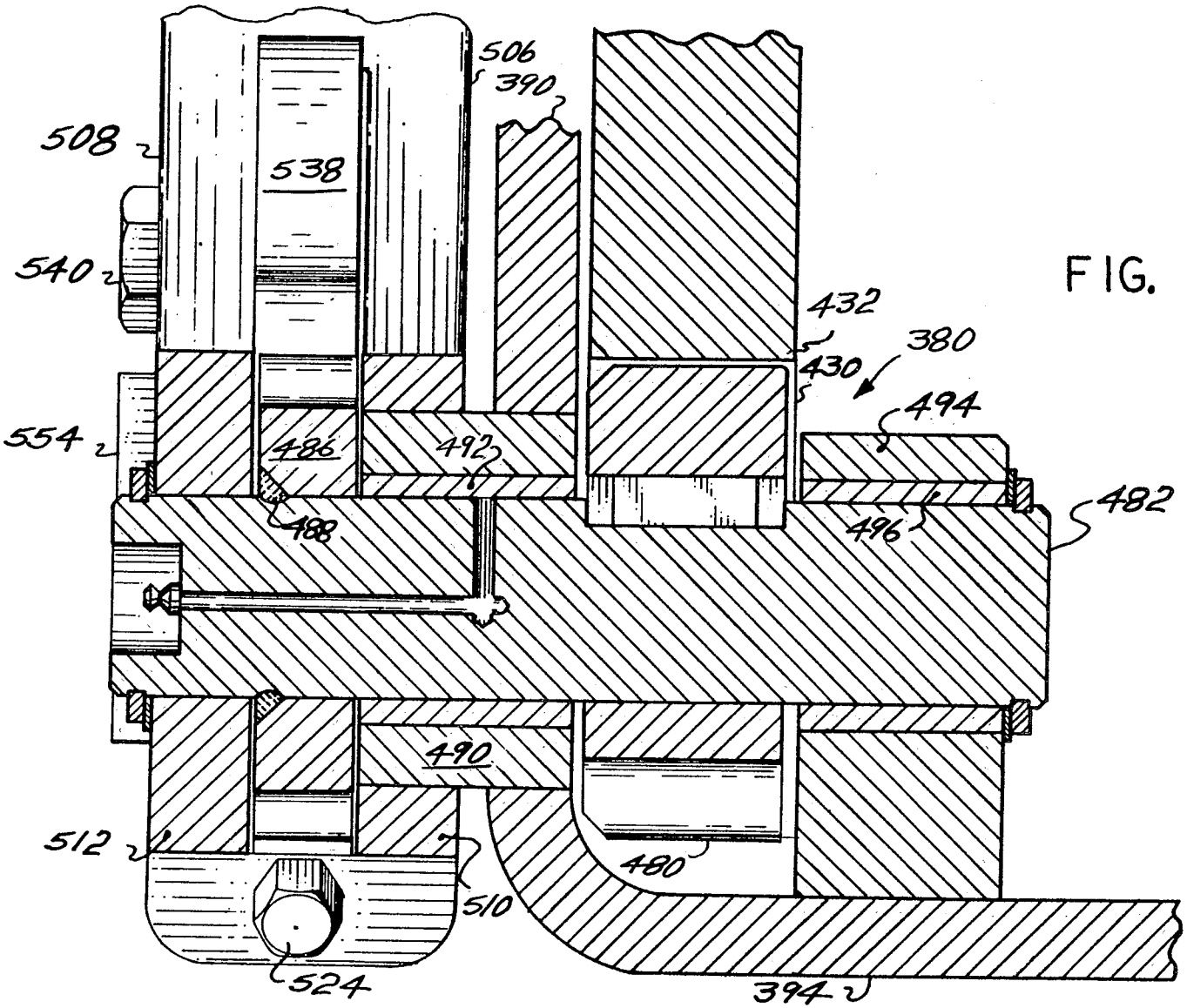
Figure 42:
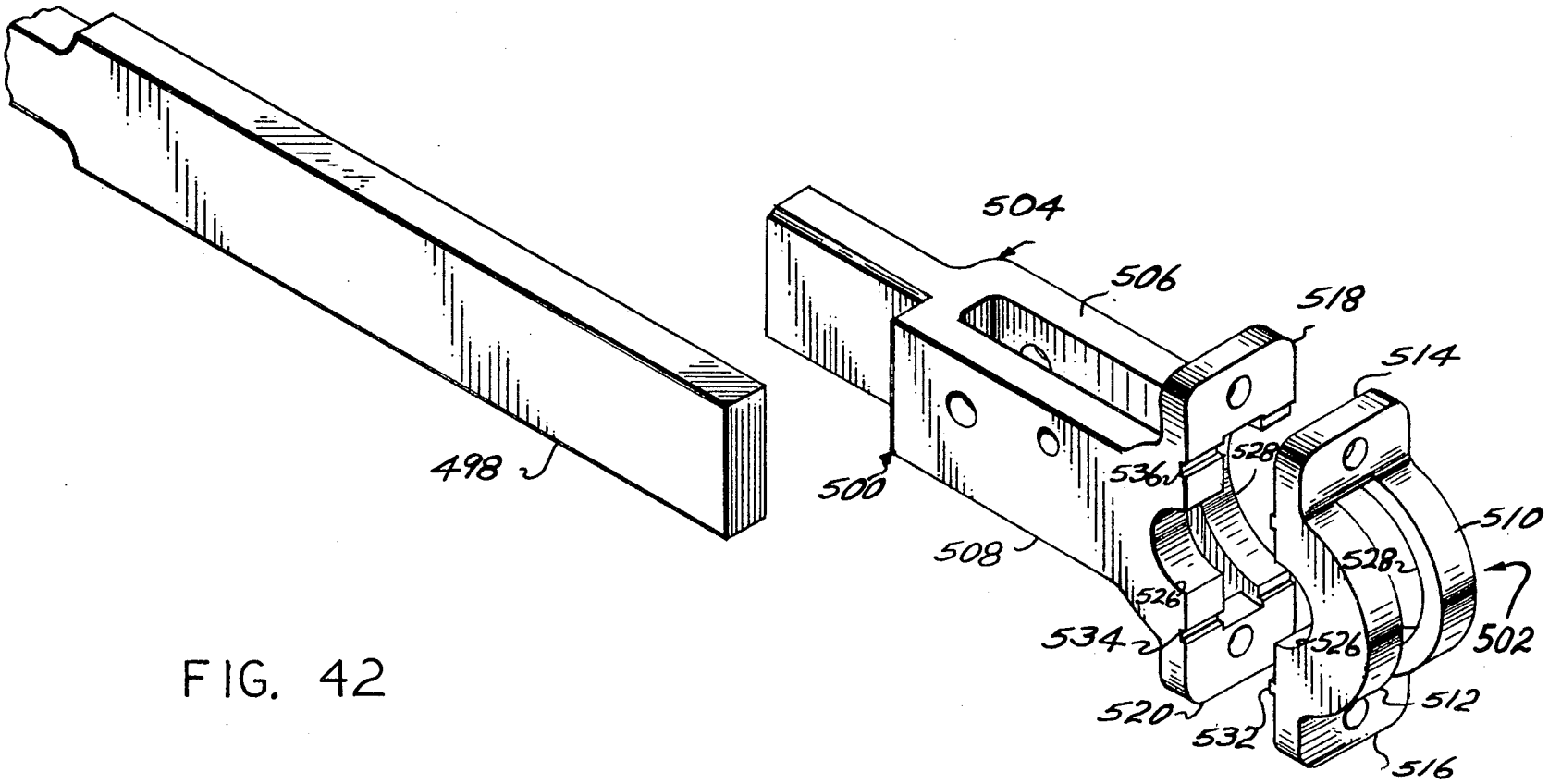
Figure 43:
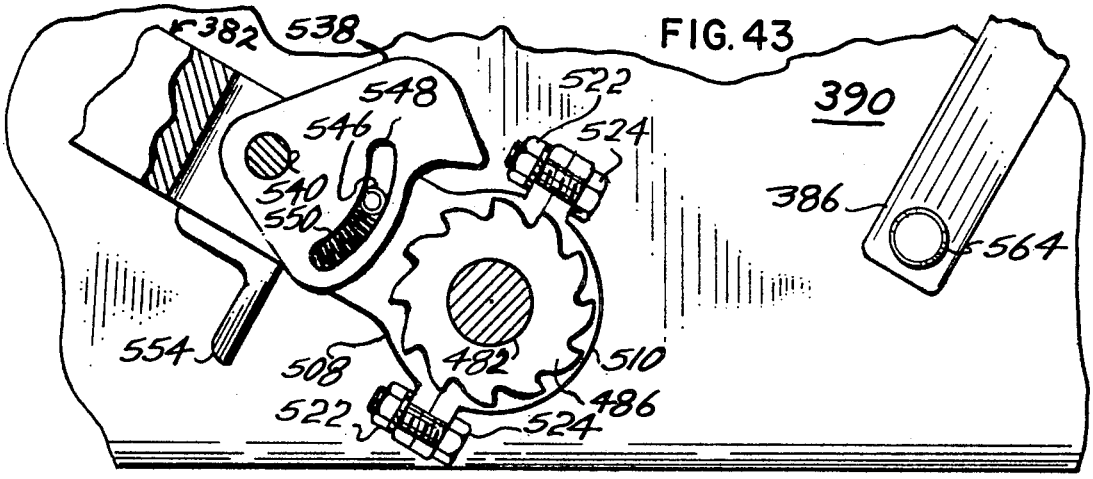
Figure 44:
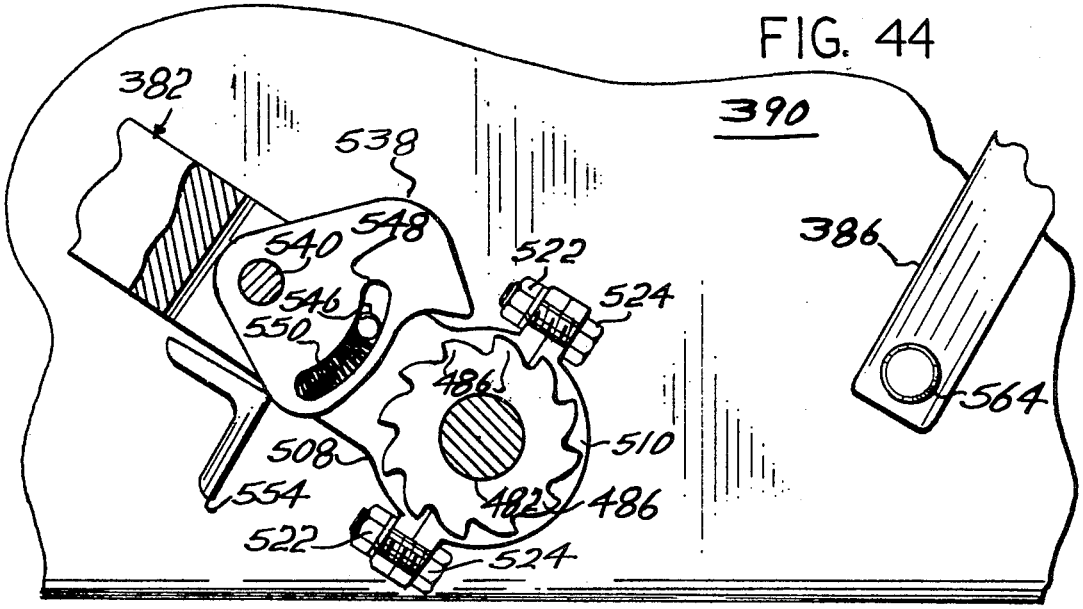
Figure 45:
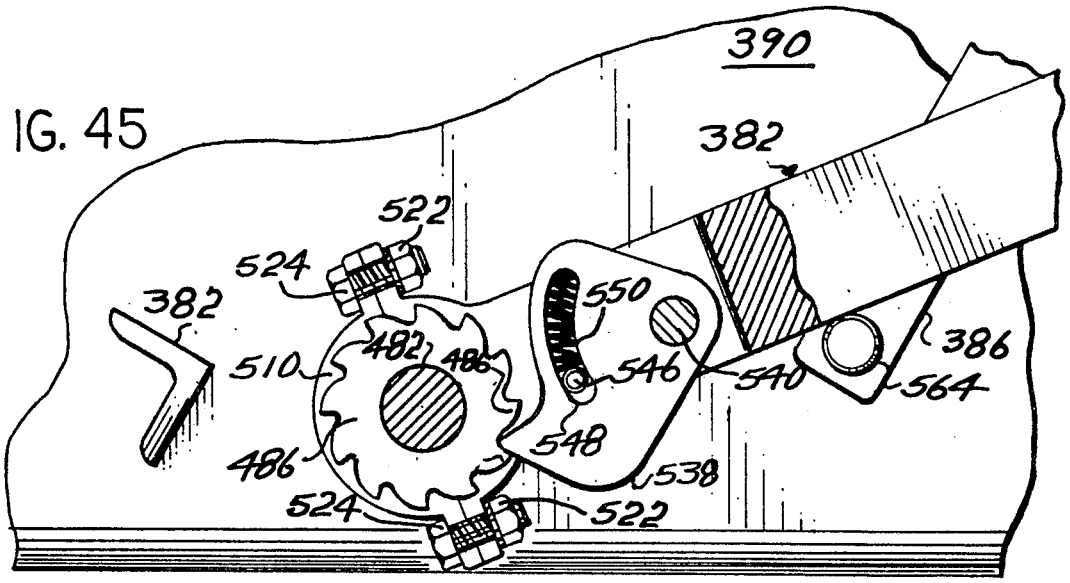
Figure 46:
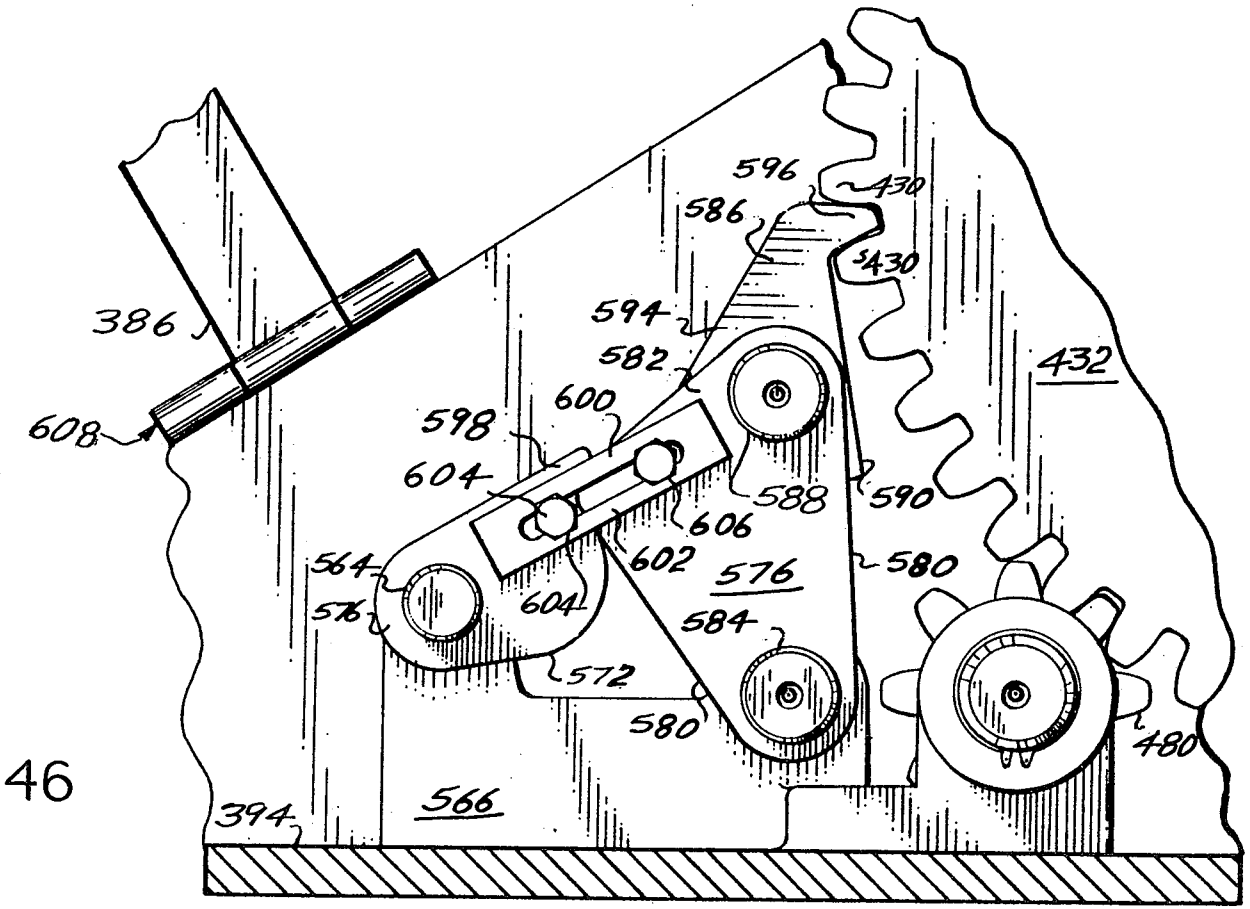
Figure 47:
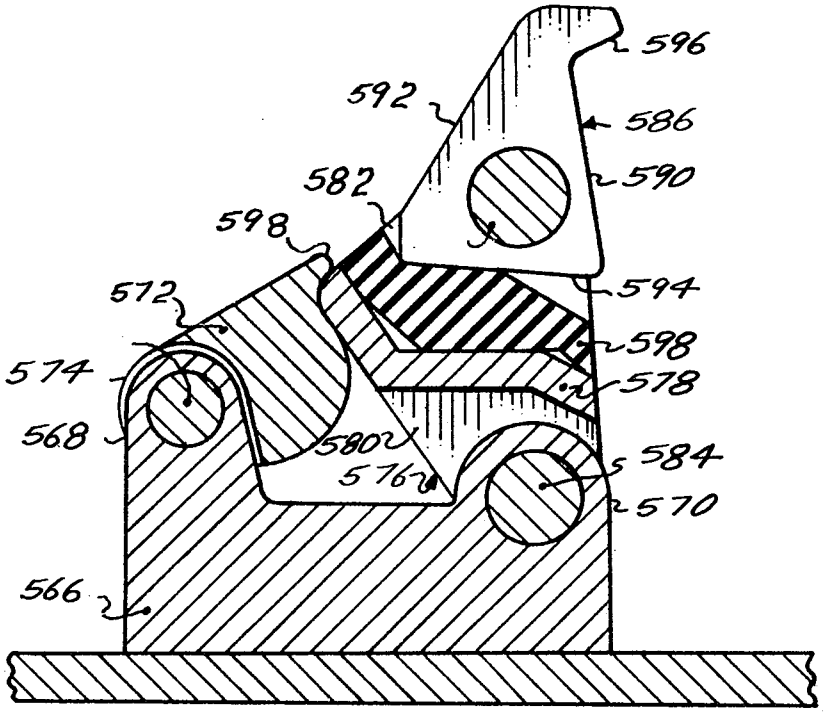
Figure 49:
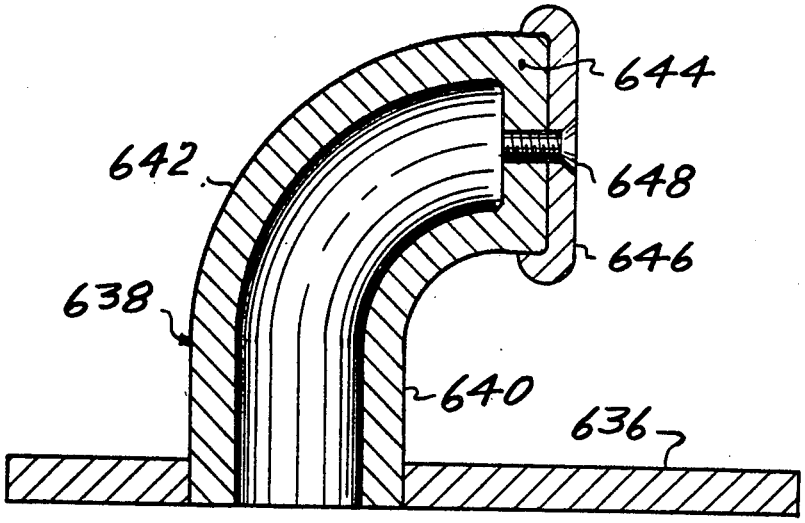
Figure 48:
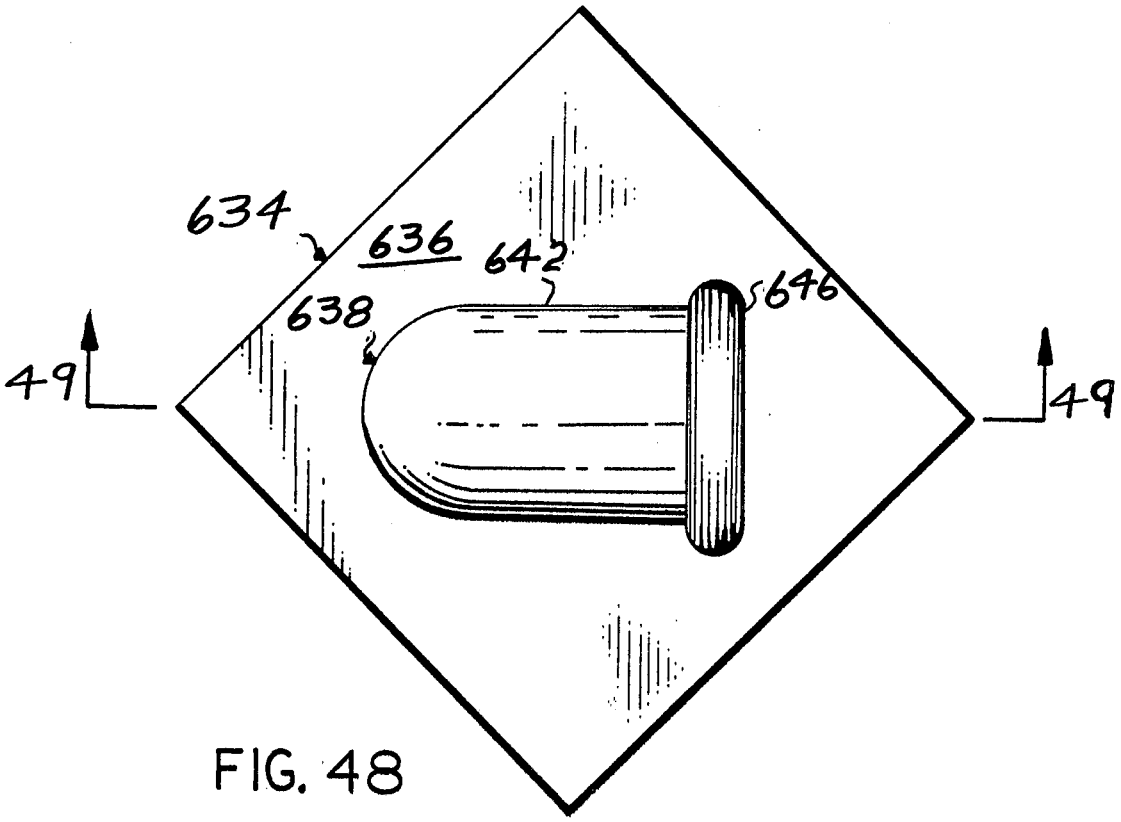
Figure 50:
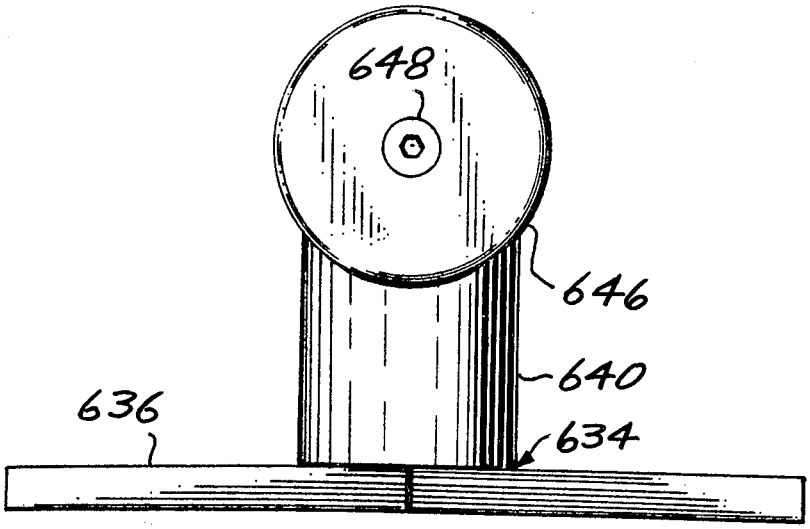
Figure 51:
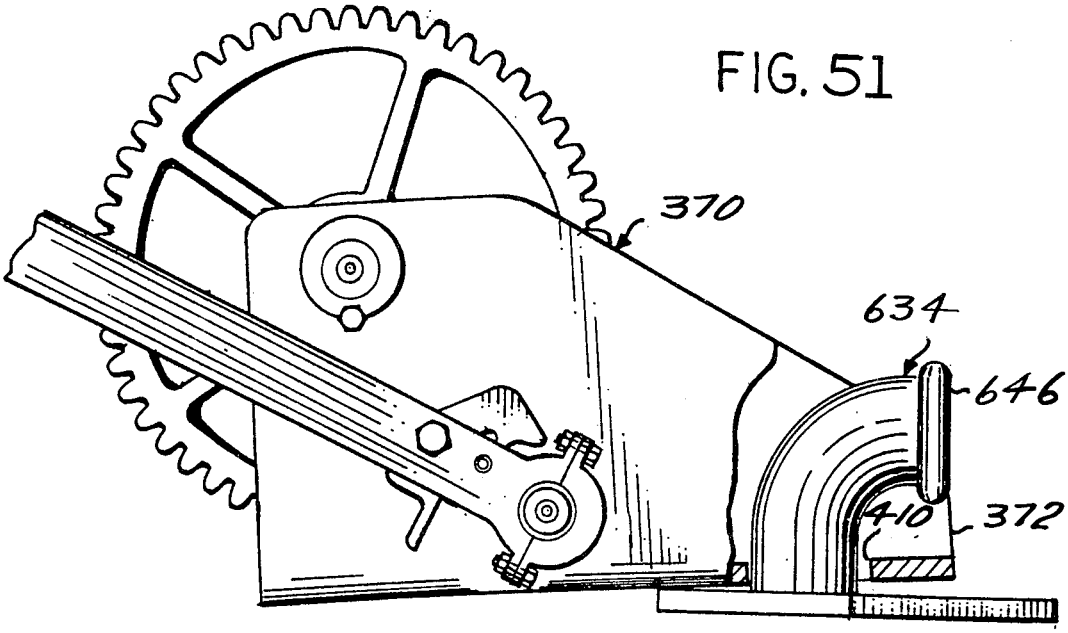

FIG. 36, on an enlarged scale, is a cross-sectional view of the hand brake in operating position relative to the winch frame and winch drum;

FIG. 37, on an enlarged scale, is a perspective view of the drum shaft;

FIG. 38 is a cross-sectional view of the drum shaft taken at line 10—10 of FIG. 37;

FIG. 39, on a reduced scale, is an end-elevational view of the driven end of the drum and showing the cable-locking pawl;

FIG. 40 is a cross-sectional view of the drum taken at line 40—40 of FIG. 39;

FIG. 41, on an enlarged scale, is a cross-sectional view of the winch drive mechanism taken on line 41—41 of FIG. 33; FIG. 42, on an enlarged scale, is a perspective, exploded view of the operating handle;

FIG. 43 is a side-elevational view of the handle, ratchet and detent pawl with the detent pawl out of engagement with the ratchet;

FIG. 44 is a side-elevational view of the detent pawl about to engage the ratchet;

FIG. 45 is a side-elevational view of the detent pawl in contact with the ratchet, and after the handle, the detent pawl and the ratchet have been rotated over 90°;

FIG. 46, on an enlarged scale, is an elevation of the locking mechanism to prevent the rotation of the drum and the unwinding of the line;

FIG. 47, on an enlarged scale, is a cross-sectional view of the locking mechanism and shows details of the construction of the component;

FIG. 48 is a plan view of the winch-mounting stand;

FIG. 49, taken at line 49—49 of FIG. 48 is a cross-sectional view of the winch-mounting stand;

FIG. 50 is an end-elevational view of the mounting stand; and,

FIG. 51, on a reduced scale, is a side-elevational view of the winch assembled to the mounting stand with one side of the winch frame, partially, broken away to more completely show the cooperation of the winch frame and the mounting stand.

THE DETAILED DESCRIPTION OF THE INVENTION

Figure 6:
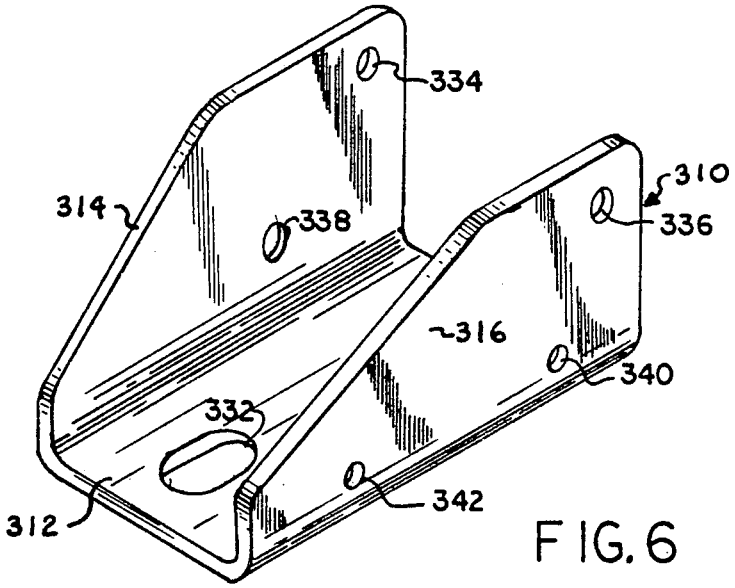
FIG. 6 is a perspective view of the completed unitary winch frame.

With reference to FIG. 6, it is seen that there is illustrated a unitary frame 310 comprising a base 312 and two spaced-apart upright sides 314 and 316.

In FIG. 6, it is seen that the sides 314 and 316 are substantially parallel and, also, are substantially at right angles to the base 312.

Figure 3:
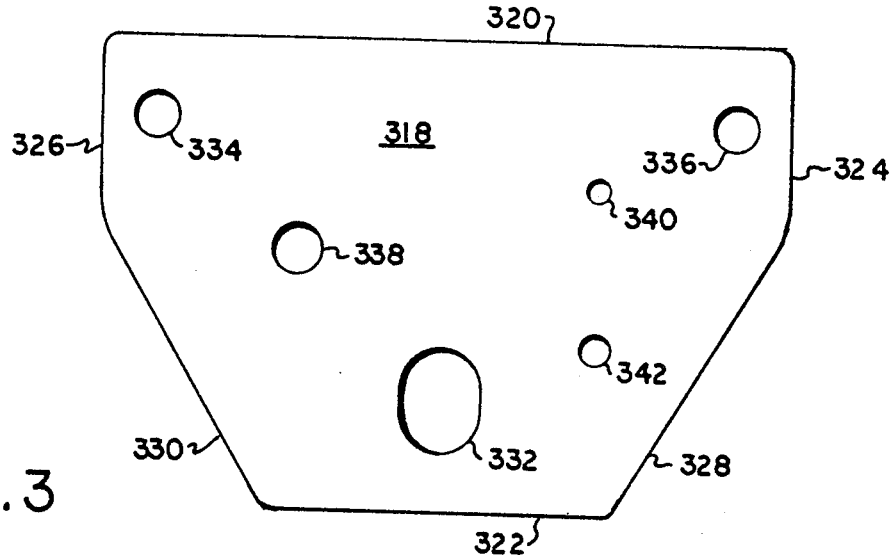
FIG. 3 is a plan view of the steel plate from which the unitary winch frame is formed.

In FIG. 3, it is seen that there is a substantially flat plate or blank 318. The plate or blank 318 may be considered to be, in the plan view, of a modified trapezoidal configuration having a long end 320 and a short end 322. The ends 320 and 322 are substantially parallel. Then, on the outside of the end 320 there are two short sides 324 and 326. The short sides 324 and 326 are substantially parallel. Then, the short side 324 connects with the short end 322 by means of a diagonal 328, and the short side 326 connects by means of a diagonal 330 with the short end 322.

The substantially flat plate or blank 318 is at least 3/16 of an inch thick and comprises a steel plate or alloys of steel.

It is seen that in the blank 318 there is a hole or passageway 332. The hole or passageway 332 is of a generally elliptical configuration or of an elongated circle.

Further, near the short edge 326 there is a hole or passageway 334 and near the short edge 324 there is a hole or passageway 336. There is a hole or passageway 338 between the holes or passageway 332 and 334. Further, between the holes and passageways 332 and 336 there are two holes or passageways 340 and 342.

Figure 4:
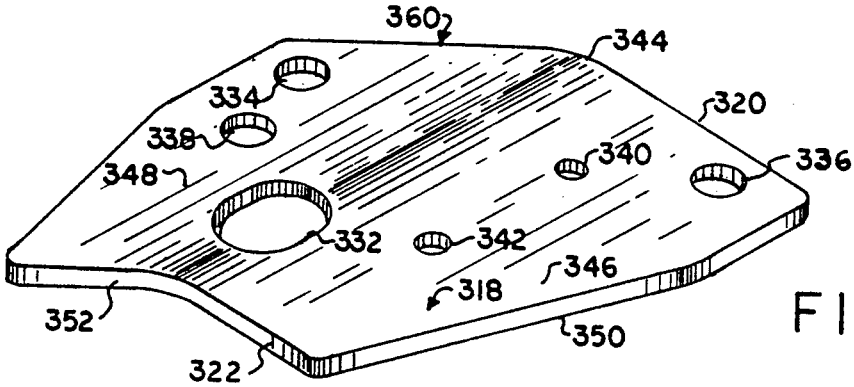
FIG. 4 is a perspective view of the plate of FIG. 3 in a further stage of its formation into the unitary winch frame.

In FIG. 4 there is illustrated the blank 318, after it has been worked so as to have a longitudinal ridge 344. The longitudinal ridge runs from the long end 320 to the short end 322, and also passes through the passageway 332.

With the bending of the plate 318 to define a ridge 344 it is seen that there is produced a first outer surface 346, a second outer surface 348, a first inner surface 350 and a second inner surface 352.

The first outer surface 346 and the first inner surface 350 are on that side of the ridge having the holes or passageways 336 and 342. The second outer surface 348 and the second inner surface 352 are on that side of the ridge 344 having holes or passageways 334 and 338.

In FIG. 4 it is seen that the plate 318 has now assumed the configuration of an inverted V-shape, identified by reference numeral 360.

The V-shape 360 is further worked so as to bend upwardly the outer edges of the first outer surface 346 and the second outer surface 348.

Figure 5:
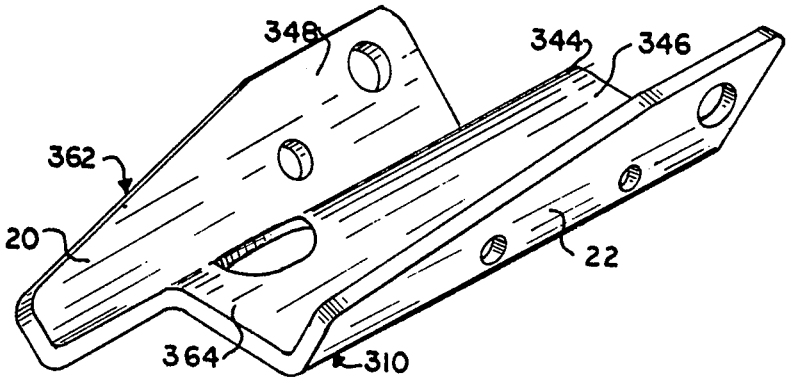
FIG. 5 is a perspective view of the plate of FIG. 4 in a yet further stage of its formation into the unitary winch frame.

The V-shape 360 is further worked to form the intermediate shape 362, see FIG. 5. In 362 the outer part of the first outer surface 346 has been worked or bent so as to overlie the inner part of the first outer surface 346 and to project upwardly as the ridge 344 projects upwardly. Similarly, the outer part of the second outer surface 348 is worked to overlie the inner part of said second outer surface and to project upwardly in a direction as the ridge 344 projects upwardly. In an end elevation view the material assumes the shape 362, a W-shape.

In FIG. 5, it is seen that the object 362 has a W-shape.

Then, the ridge 344 is depressed so that the inner parts of the first outer surface 346 and the second outer surface 348 are made to be substantially flat and a substantially continuous surface identified as the base 364. In FIG. 5 it is seen that if the ridge is forced so as to become essentially flat and the surface to be a substantially continuous flat surface that the sides 314 and 316 will rotate inwardly toward each other. With the rotation of the sides 314 and 316 inwardly towards each other there results the frame 310. The frame 310 has the two spacedapart upright sides 314 and 316 and the base 324. The sides 314 and 316 are continuous with the base 364. Also, the upright sides 314 and 316 are substantially parallel and substantially at right angles to the base 364.

From the foregoing it is seen that there is provided a method for making a unitary frame for a winch. The unitary frame for the winch is made from a substantially flat plate or substantially flat piece of steel or an alloy of steel relatively thick, at least three-sixteenths of an inch thick. We have actually made a frame 310 from a steel plate 318 having a thickness of five-eighths inch. We consider that the method of manufacture of this unitary frame is less expensive than for a fabricated frame, fabricated from three pieces and welded into an integral frame. Also, we consider that less time is expended because it is not necessary to manually weld the three pieces into an integral frame and it is not necessary to grind the excess weld to give a more finished appearance. In fact, the frame 310 we have manufactured has a finished appearance because it is a continuous frame without rough edges or welds which have been ground to be more presentable. Further, we consider the frame 310, because of its unitary structure, to be stronger than a fabricated frame or an integral frame. There are no welds to receive moisture, or if working around salt water, to receive a salt spray, and to corrode, rust and become weak.

Formed, integrally, with the drum 8, there is a drum gear 10 and a first ratchet 12 or a drum ratchet 12. A hand operated mechanism to lock the first ratchet 12 against rotation under load is indicated generally by 14. A hand operated pawl-and-ratchet mechanism to drive the winch in such a direction as to take a strain on a cable, is indicated generally by 16.

Figure 7:
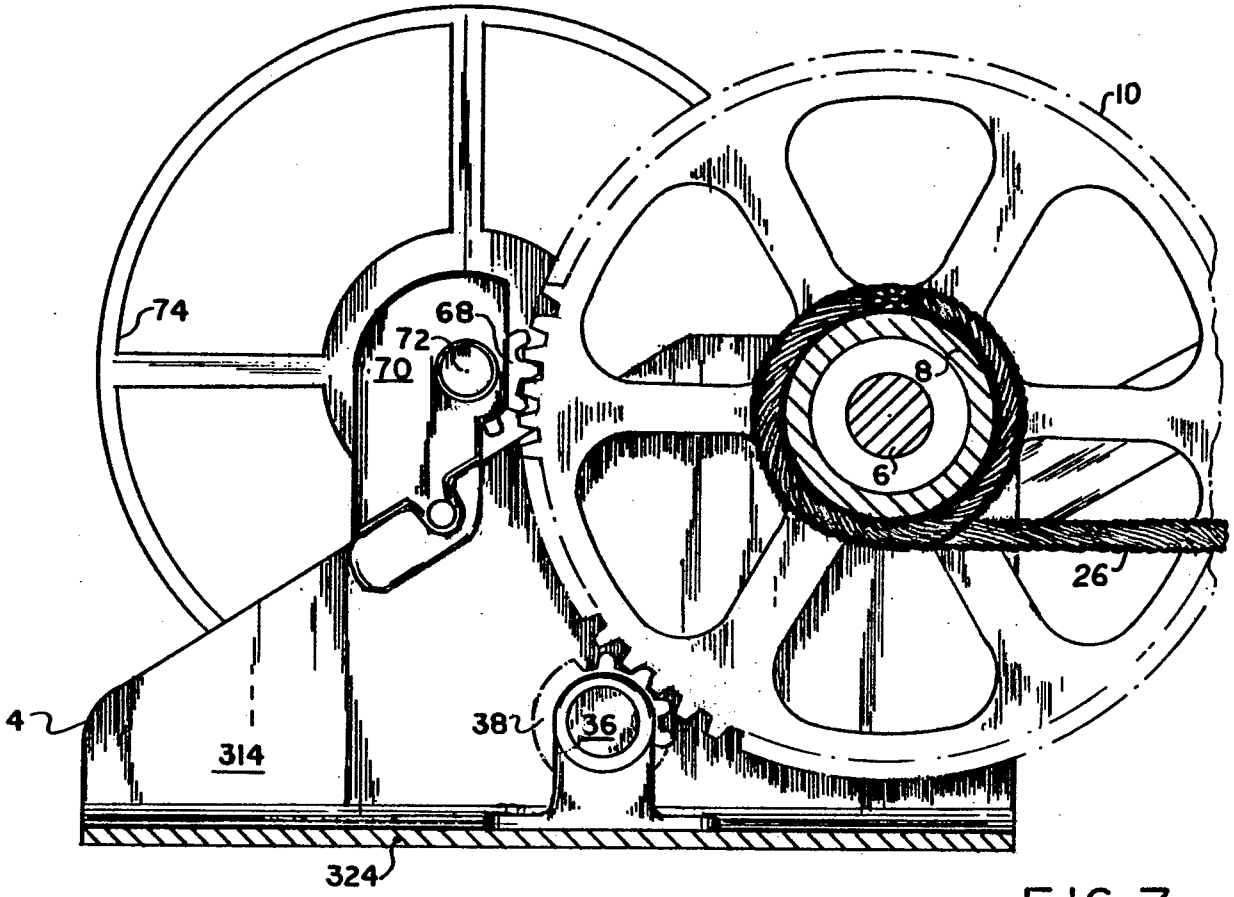
FIG. 7 is a longitudinal, vertical, cross-sectional view of one embodiment of the winch having a hand wheel for rotating the drum for winding the cable.
Figure 8:
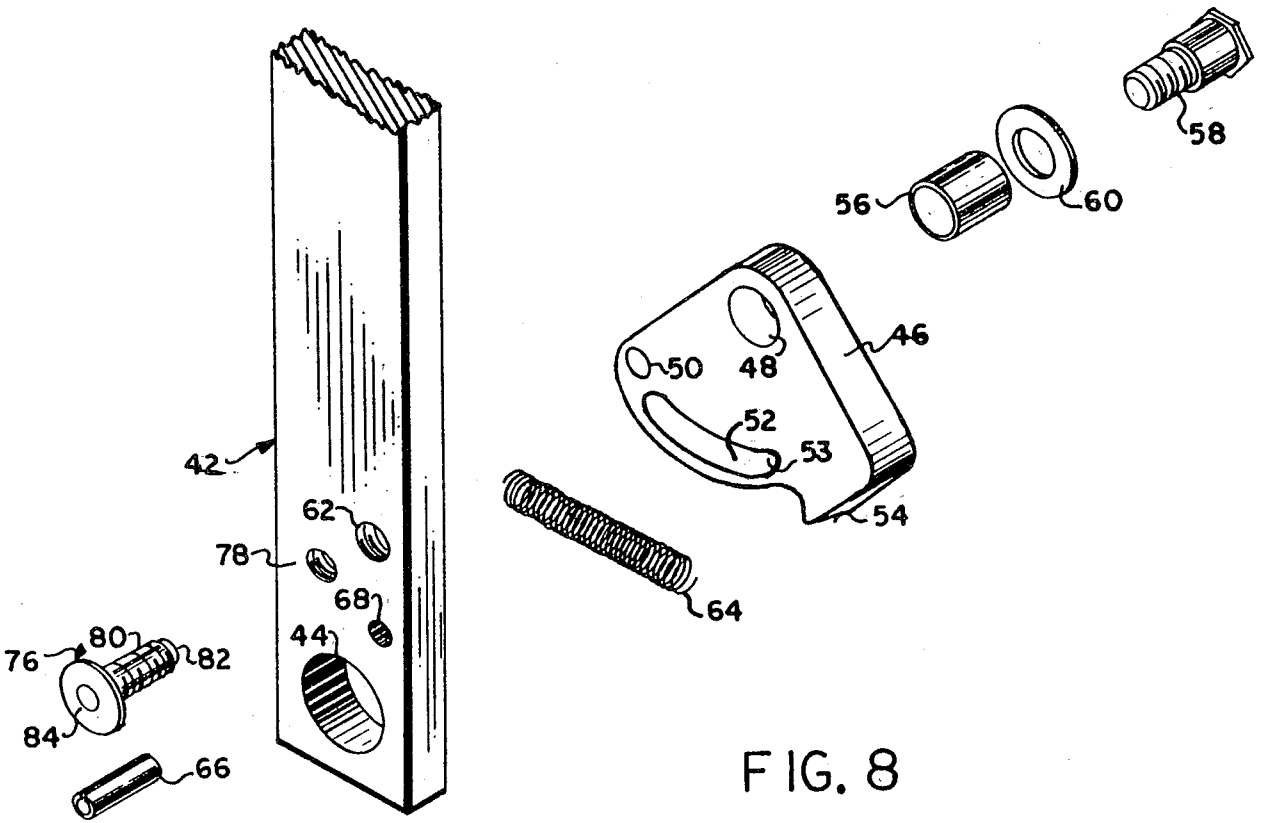
FIG. 8 is an exploded view of the operating handle-and-pawl assembly, and showing, only, a fragmentary portion of the handle.

In FIG. 7 there is shown a cable 26, which leads from the bottom of the horizontal drum 8 to the load (not shown). It is apparent that in order to rotate the drum 8 so as to place a strain on the cable 26, the drum gear 10 and the first ratchet 12 must rotate in a clockwise direction with respect to the view shown in FIG. 7.

Figure 1:
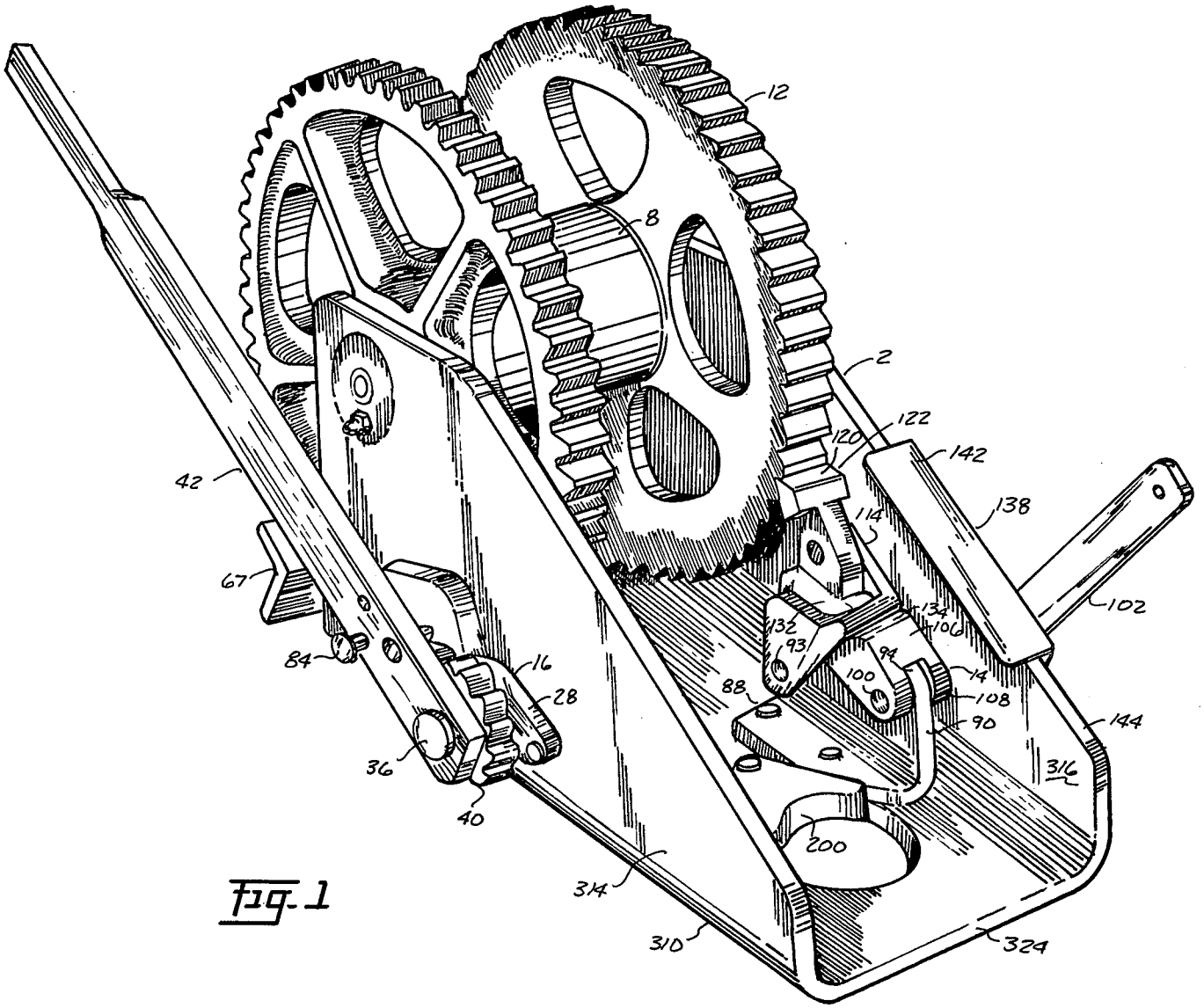
FIG. 1 is a perspective view of the hand-operated winch.
Figure 2:
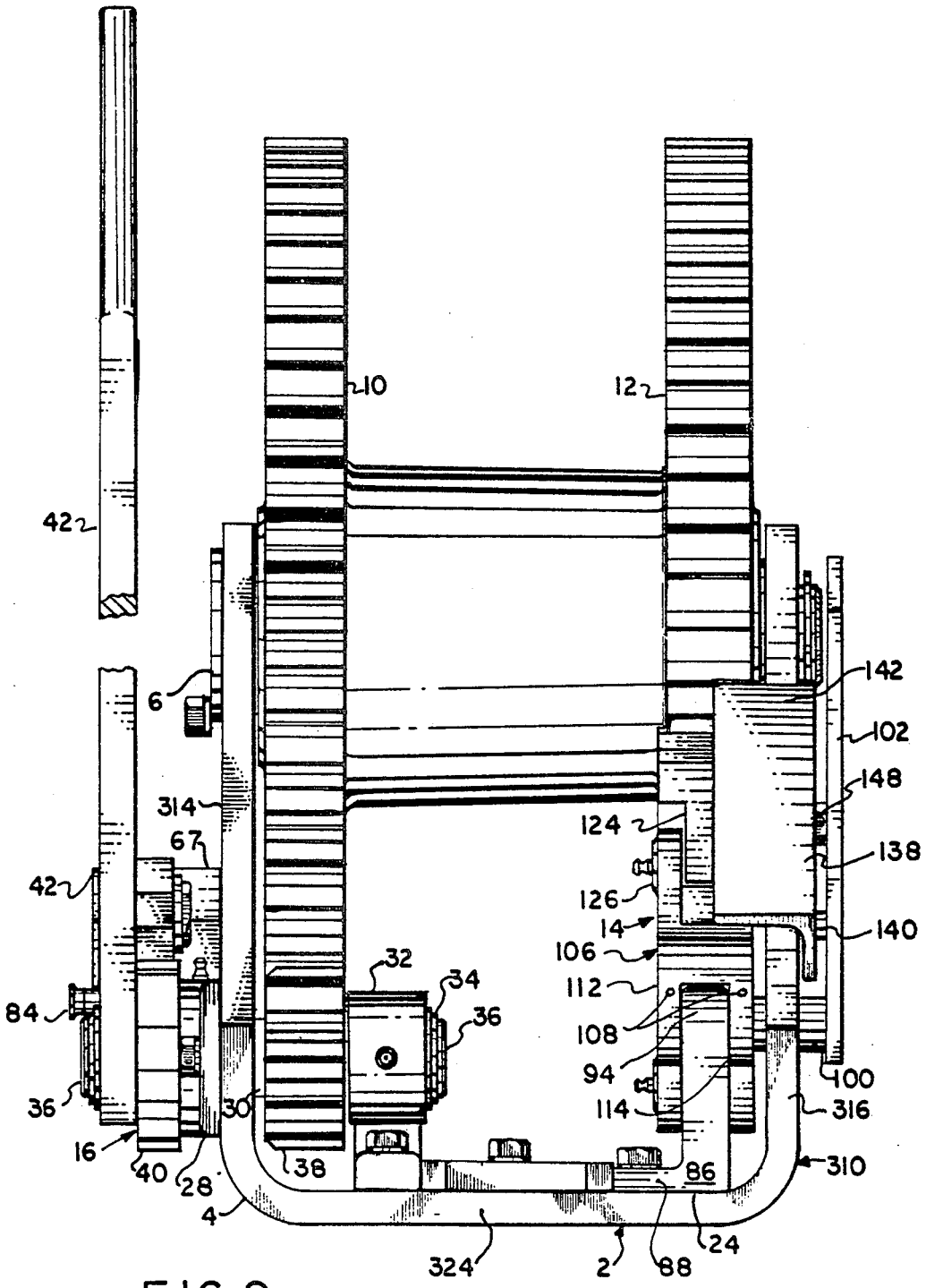
FIG. 2 is a front elevational view, with a handle partially broken away.

Details of driving mechanism 16 are illustrated in FIGS. 1, 2, 7 and 8. There is a flanged bearing support 28 fixed to side 314. There is an inboard bearing 32 mounted on base 324 and a bearing 30 in the passageway 338 in the side wall 314. Bearings 30 and 34 are longitudinally aligned. There is a shaft 36. Keyed to shaft 36 are drive pinion 38 and drive ratchet 40. It is seen in FIG. 2 that shaft 36 extends through the passageway 338 in side 314, whereas drive pinion 38 is supported inside the frame 310. Drive pinion 38 is in a meshing relationship with drum gear 10, see FIGS. 2 and 7. There is a handle 42 having near one end thereof, a passageway 44, see FIG. 8. The passageway 44 is larger in internal diameter than the external diameter of the shaft 36, so that when handle 42 is assembled to shaft 36, it will rotate around shaft 36. It will thus be seen that the center line of shaft 36 is a pivot point for handle 42. There is a first pawl 46, having therein a hole 48, a hole 50, and an arcuate slot 52. At one end of first pawl 46 is formed a tooth 54 designed to mesh with the teeth of drive ratchet 40. Slidably fitted within hole 48 is a sleeve 56. The first pawl 46 is rotatably mounted to the side of handle 42 by bolt 58 which extends through washer 60 and sleeve 56 and engages with threaded hole 62 in the handle 42. Within slot 52 and resting against the left end thereof, there is a spring 64. There is a drive pin 66 tightly fitted into hole 68 in handle 42. The diameter of drive pin 66 is such as to slide within slot 52 in the first pawl 46. Drive pin 66, operated by handle 42, travels in the right portion of slot 52. The drive pin 66 is urged against the right end 53 of slot 52 by spring 64. The sides of slot 52 are formed by radii of curvature whose center is the center line of holes 48 in the first pawl 46. It is seen, that, when handle 42 is rotated in a clockwise direction, tooth 54 on the first pawl 46 will also move in a clockwise direction and, being enmeshed with drive ratchet 40, will tend to rotate drive ratchet 40 in a clockwise direction. it can further be seen, that when handle 42 is rotated in a counter-clockwise direction, the spring 64 in slot 52 allows the first pawl 46 to ride over successive teeth of drive ratchet 40. Inasmuch as drive pinion 38 and drive ratchet 40 are keyed to the same shaft 36, and drive pinion 38 is enmeshed with drum gear 10, it can be seen that when handle 42 is rocked back and forth, it will tend to drive drum gear 10 and consequently drum 8, on which cable 26 is wound, in a direction to place a strain on cable 26, when cable 26 is attached to a load, or to a fixed point. There is a handle stop 67 fixed to the side 314 to limit counter-clockwise rotation of handle 42. Although the principal winch lock mechanism is described elsewhere in this specification, the handle stop 67 serves as an additional safety feature to prevent loosening of the cable 26 under load.

There are times, during the operation of this winch, when it will be desired to take up slack in the cable 26 in a more rapid manner than is permitted by the driving mechanism 16. For this purpose, a second drive pinion 68 may be used as illustrated in FIG. 7. The second drive pinion 68 is supported in a journal bracket 70, affixed to side 314 of frame 4. Journal bracket 70 supports a shaft 72 to which the second drive pinion 68 is keyed. Hand wheel 74 is affixed to one end of shaft 72. It can be seen that when cable 26 carries no significant load, the drum 8 can be rapidly rotated by turning the second drive pinion 68. The pawland-ratchet driving mechanism 16 will permit drive ratchet 40 to rotate when the hand wheel 74 is being turned in a direction to take up slack in cable 26.

A means is provided to lock the first pawl 46 out of engagement with the drive ratchet 40. A spring loaded pin assembly 76 extends through hole 78 in handle 42 toward hole 50 in the first pawl 46. The barrel 80 of the spring loaded pin assembly 76 is threaded into hole 78. First pawl 46 can be rotated around bolt 58 to an area where the tooth 54 of the first pawl 46 is out of contact with drive ratchet 40. Then, first pawl 46 can be further rotated to a point where the spring loaded pin 82 will engage with hole 50 in the first pawl 46. The first pawl 46 will remain out of contact with the drive ratchet 40, until the spring loaded pin 82 is withdrawn from hole 50 by pulling on button 84 on the other end of the spring loaded pin 82. Spring 64, working against drive pin 66, will then force the first pawl 46 back into contact with drive ratchet 40.

The locking and release mechanism, generally denoted by 14, and illustrated in FIGS. 1, 2, 9, 10, 27 and 28, is supported by inboard support 86, which is fixed to base 24 of frame 4. Inboard support 86 has a flat base 88. Extending upwardly from one side of the base 88 is an upright support 90. Vertical support 90 has at one end of its upper edge and ear 92, and at the other end of its upper edge an ear 94. Between ears 92 and 94 and forming the upper edge of vertical support 90 is a flat surface 96. Extending through, and supported by ear 94 and side 316 of frame 4, there is a shaft 100, being attached at one end to a handle 102. Affixed to shaft 100 by means of pins 104 is cam 106, see FIG. 9. Cam 106 has spaced-apart legs 108. Passageway 110 extends through both spaced-apart legs 108. Shaft 100 extends through passageway 110. The spaced-apart legs 108 straddle ear 94 of inboard support 86. Rotatably mounted on pin 93 which projects through ear 92 of inboard support 86, is a pawl link 112. Pawl link 112 comprises two spaced-apart generally triangular plates 114. Connecting the two plates 114 is a base portion 116. On the outer side of base portion 116 there is a flat surface 118. There is a rotatable second pawl 120 having a tooth 122 designed to mesh with the first ratchet 12. Depending from the tooth 122 is the base member 124. Base member 124 of second pawl 120 fits between the triangular plates 114 of pawl link 112, as illustrated in FIG. 2. Second pawl 120 rotates on pin 126 which is supported in the triangular plates 114 of pawl link 112. The void between the flat member 124 of the second pawl 120 and the base portion 116 of pawl link 112 is occupied by a rubber block 132 which absorbs and distributes pressure from the second pawl 120. The rubber block 132 must be able to withstand the compressive forces exerted on it by the rotatable pawl 120. Block 132 must be resilient and elastic with memory so as to be capable of deformation and also be capable of returning to its original configuration after being compressed. The rubber block 132 may be another plastic block other than rubber such as a block of polyurethane, polyethylene and polypropylene.

Figure 9:
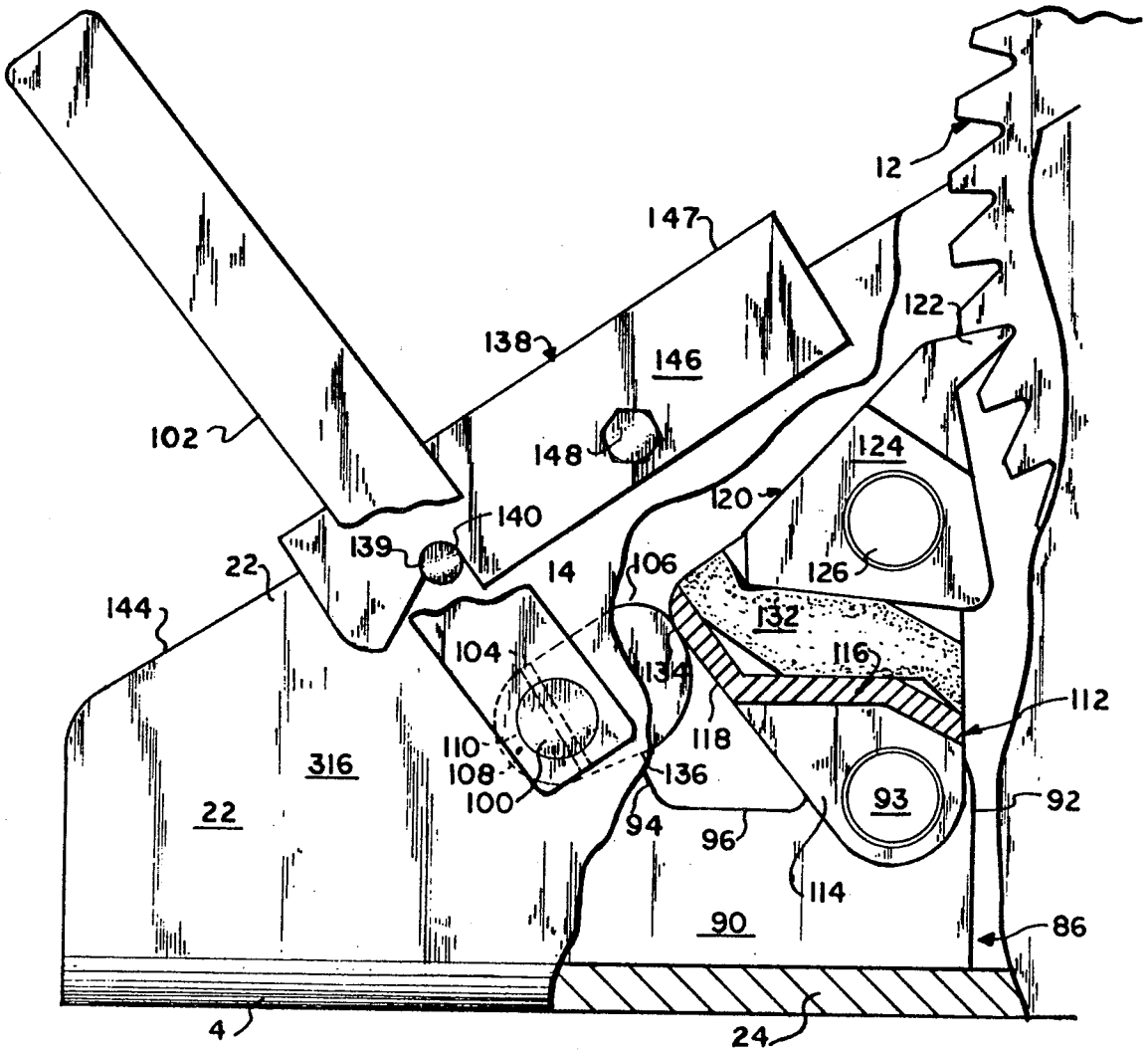
FIG. 9 is an elevational view of a portion of the right side of the winch, partially, broken away to show the locking mechanism to lock the drum in position.
Figure 10:
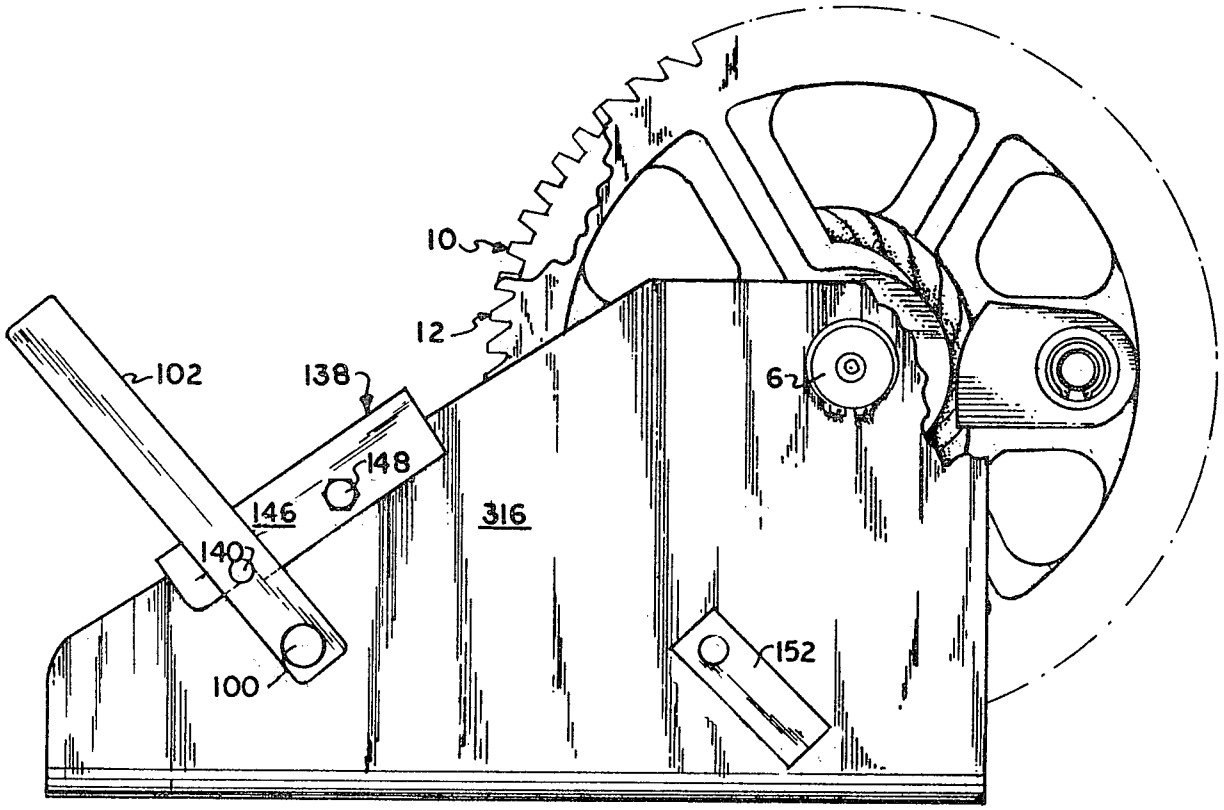
FIG. 10 is an elevational view of the ring side of the winch, partially, broken away to show the cable locking pawl for positioning the cable with respect to the drum.

In FIG. 9, it is seen that cam 106 has a first lobe surface 134 and a second surface 136. When the locking and release mechanism 14 is in the position shown in FIG. 1, it is seen that cam 106 is rotated into a position where the first lobe surface 134 is in contact with the flat surface 118 of pawl link 112. Pawl link 112 is thus forced to rotate to the right or, to rotate counterclockwise, carrying with it second pawl 120. Tooth 122 of second pawl 120 is thus forced into contact with the first ratchet 12. It is seen that because of the design of flat surface 118 and the first lobe surface 134, see FIG. 9, the pawl link 120 cannot exert a turning movement on the cam 106 so as to turn the cam 106 in an unlocking direction, that is, counter-clockwise. It can also be seen that handle 102 can turn cam 106 so that cam 106 is completely out of contact with the pawl link 112, thereby allowing pawl link 112 and second pawl 120 to fall out of contact with the first ratchet 12. The rubber block 132 allows second pawl 120 to rock so as to side over the teeth of first ratchet 12, when the first ratchet 12 is turned clockwise by drum 8 in a direction to take the strain on cable 26. Rotation of cam 106 in a locking position is limited by the second lobe surface 136 of cam 106 being in contact with ear 94.

Inadvertent release of the locking and release mechanism 14 is prevented by the interaction of foot plate 138 and pin 140. Foot plate 138 is made of a length of angle iron. A web 142 of the angle iron overlies edge 144 of side 22. The other web 146 is parallel to the upward extending portion of side 22. The foot plate 138 pivots around bolt 148, which is screwed into side 22. Web 142 is spaced far enough above edge 144 so that the foot plate may rock around the bolt 148 to a limited extent. Extending from handle 102 into a corresponding slot 139 in foot plate 138 is pin 140. It can be seen that when the pin 140 is engaged in foot plate 138, handle 102 cannot be rotated in either direction. The location of the slot is such that pin 140 can only be engaged therein when handle 102 has moved the locking and release mechanism 14 into a locked position. The handle 102 is released by exerting a downward force on the upper portion 147 of foot plate 138 so as to rotate it in a clockwise direction (as viewed in FIG. 9), thereby disengaging foot plate 138 from pin 140.

Figure 11:
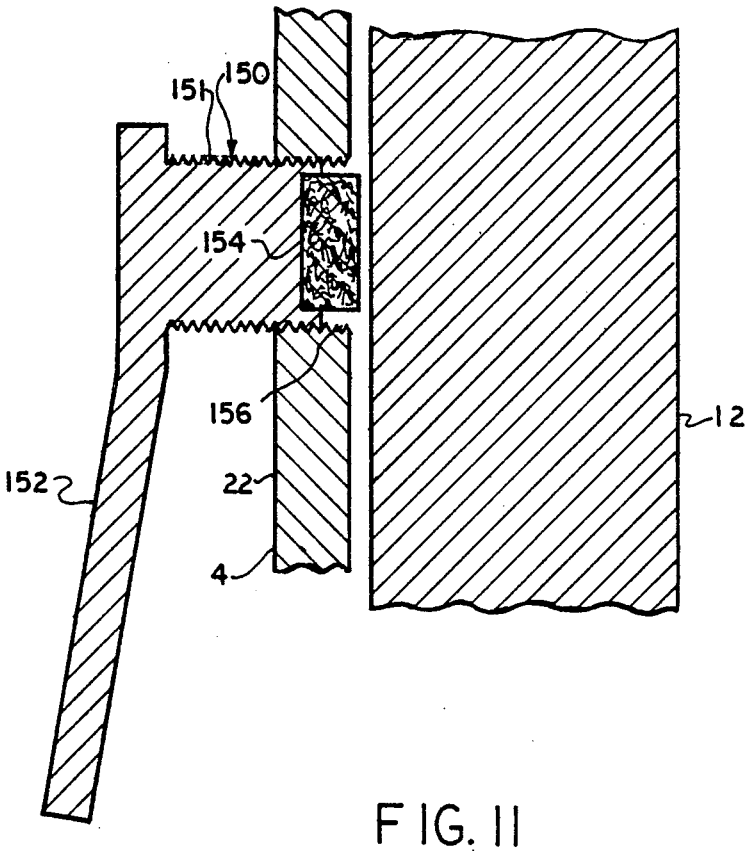
FIG. 11 is a cross-sectional view of the retarder brake assembly, taken on lines 11—11 of FIG. 26.
Figure 26:
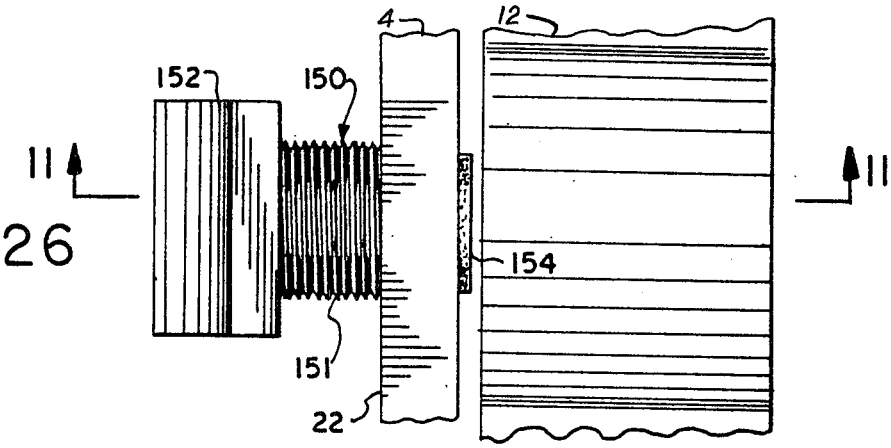
FIG. 26 is a plan view of the retarder brake assembly in place, and showing a portion of the frame and a portion of the main ratchet.
Figure 27:
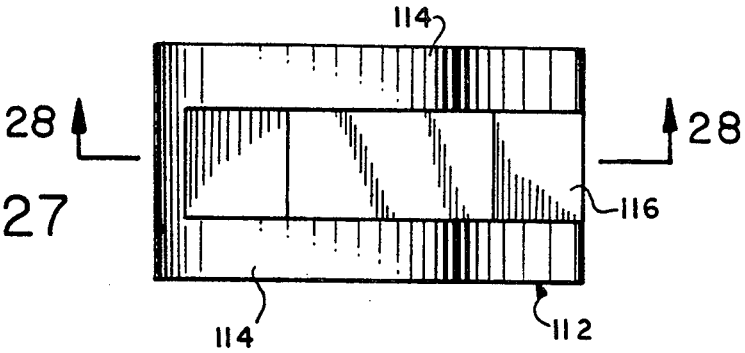
FIG. 27 is a plan view of the locking pawl link.
Figure 28:
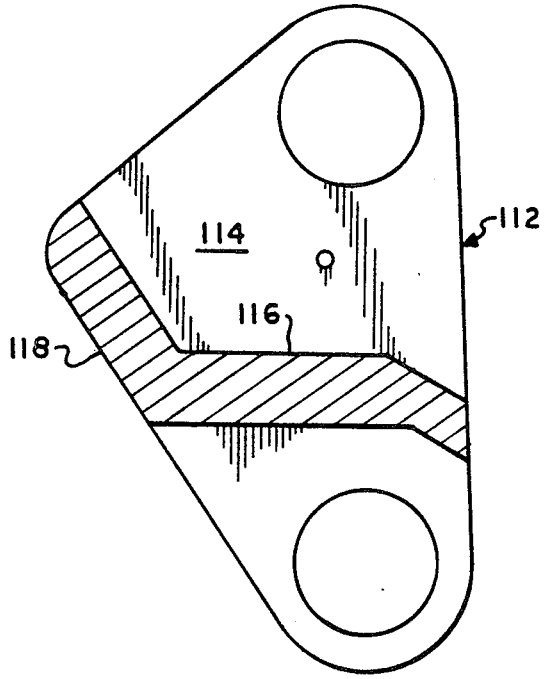
FIG. 28 is a side elevational cross-sectional view taken on line 28—28 of FIG. 27.

There is a tubular brake body 150 which is threaded at 151 on its exterior, as illustrated in FIGS. 11 and 26. Attached to one end of brake body 150 is handle 152. Extending from the other end of brake body 150 is a disc of brake lining material 154. In side 22 of frame 4 there is a threaded hole 156, which receives brake body 150. The brake body assembly consisting of brake body 150 and brake lining material 154 is of sufficient length to extend through hole 156 and to achieve a contact with the side of first ratchet 12. Thus it is possible to adjustably apply a retarding effect to the rotation of first ratchet 12.

Figure 12:
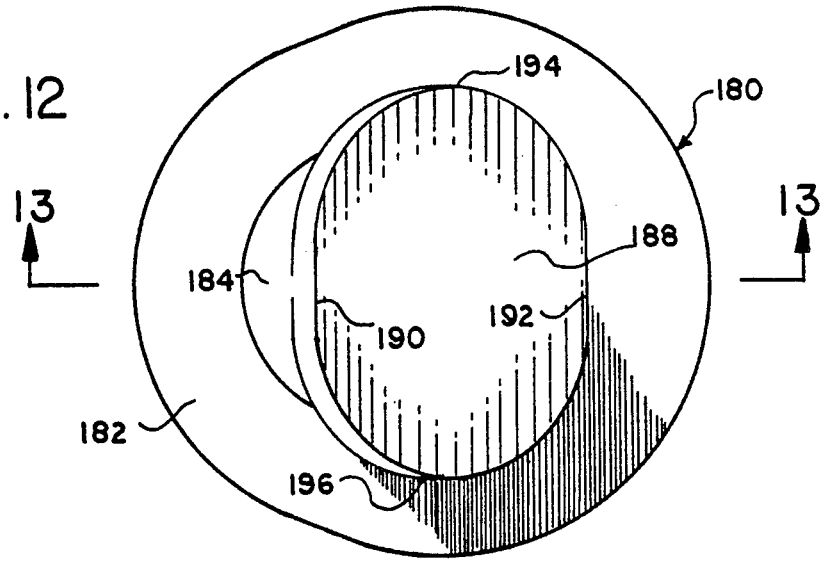
FIG. 12 is a plan view of the winch mounting stand.
Figure 13:
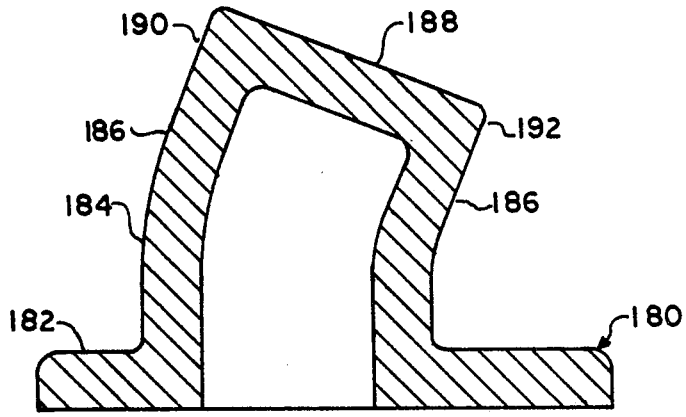
FIG. 13 is a cross-sectional view of the stand, taken at lines 13—13 of FIG. 12.
Figure 14:
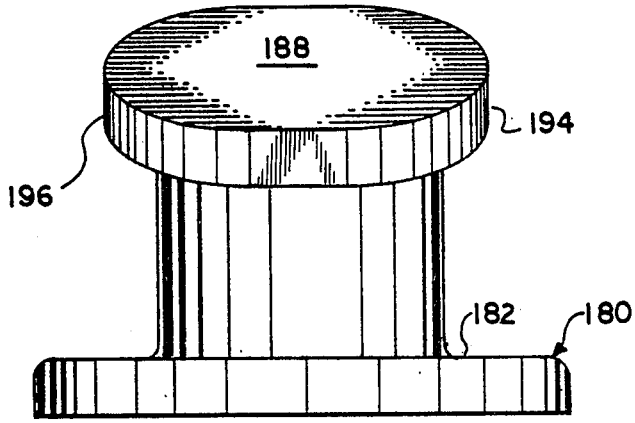
FIG. 14 is a front elevational view of the mounting stand.
Figure 15:
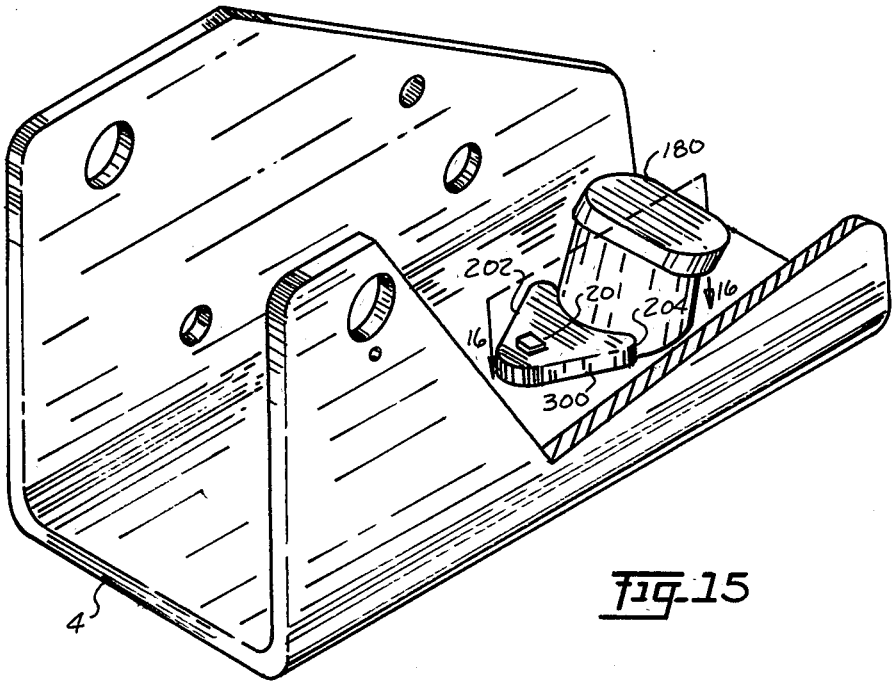
FIG. 15 is a perspective view partially borken away and showing the frame locked in place on the mounting stand.
Figure 16:
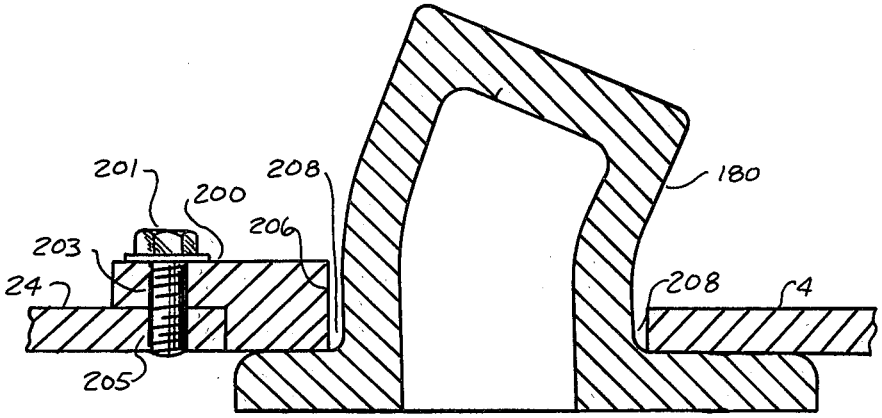
FIG. 16 is a vertical, longitudinal corss-sectional view taken at line 16—16 of FIG. 15.
Figure 17:
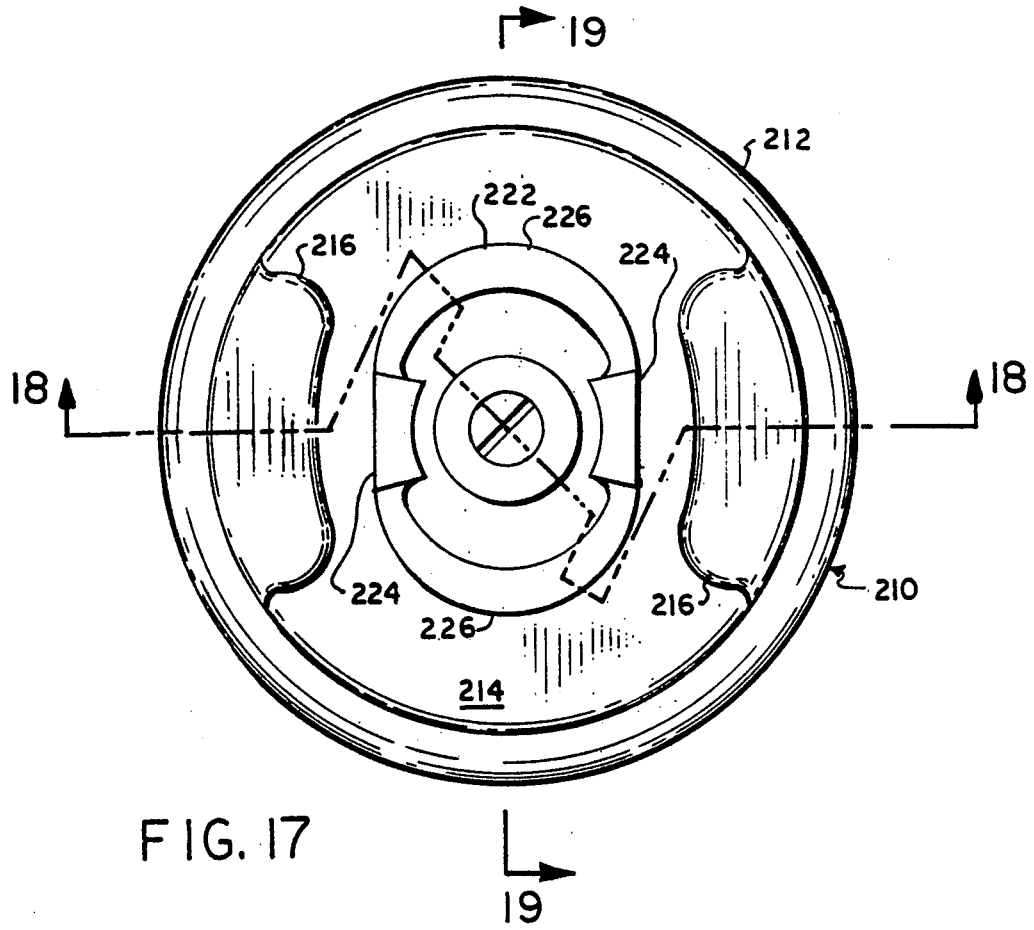
FIG. 17 is a plan view of the cable fastener.
Figure 18:
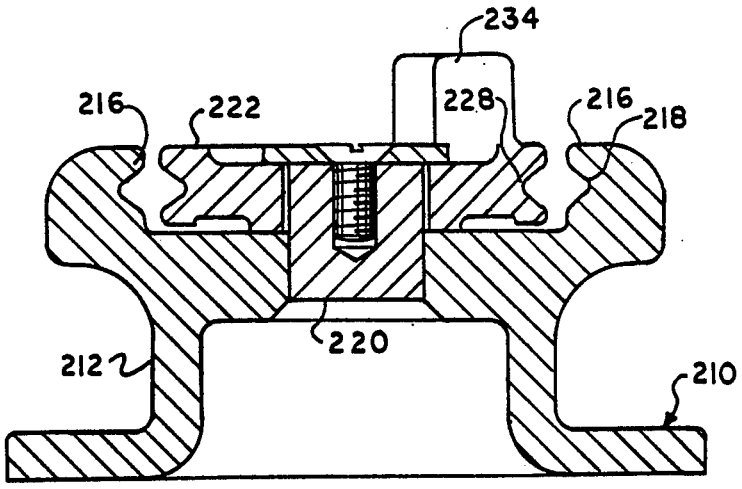
FIG. 18 is a cross-sectional view taken at line 18—18 of FIG. 17.
Figure 19:
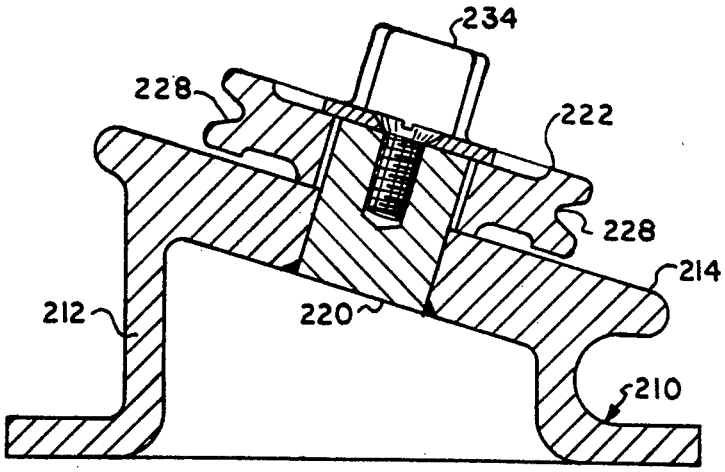
FIG. 19 is a cross-sectional view taken at line 19—19 of FIG. 17.
Figure 20:
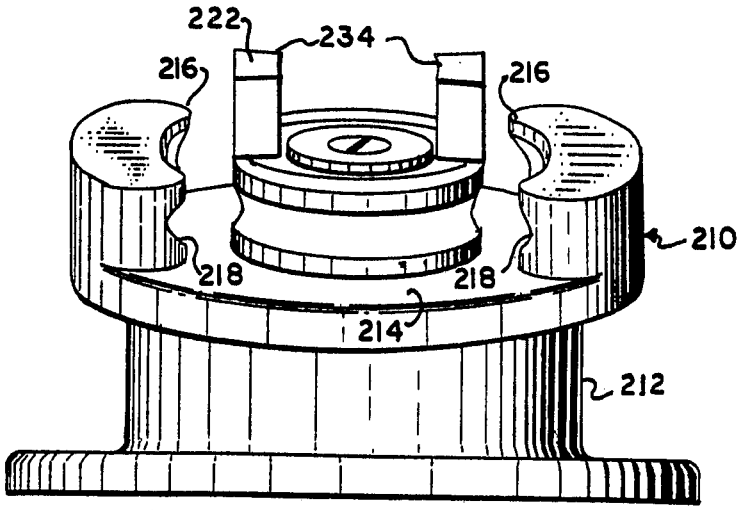
FIG. 20 is an elevational view of the cable fastener.

This invention discloses apparatus and a method for securing the winch to the deck of a barge in a manner that will permit the winch to swivel horizontally in a full circle and will also permit the winch to pivot vertically to some extent. In the following discussion the reader's attention is directed to FIGS. 12, 13, 14, 15 and 16. There is a stand, indicated generally by 180; having a flat mounting plate 182. The mounting plate may be circular. A riser 184 extends first vertically and then angularly upward from the mounting plate. The riser has a circular cross section. Thus it is seen that the upper end 186 of the riser 184 is disposed at an angle to the mounting plate 182. Disposed across the top 186 of the elbow 184, and also at an angle to the mounting plate 182, is a cap 188. The cap 188 is a flat plate having two straight opposed and parallel sides 190 and 192. The distance between the flat sides 190 and 192 is approximately equal to the outside diameter of the riser 184. The ends 194 and 196 of the cap 188 are formed by semi-circular arcs, with the ends of the arcs meeting corresponding ends of the opposed parallel sides 190 and 192. The distance between the ends 194 and 196 is greater than the diameter of the riser 184. Another way to consider the cap 188 is that of an ellipse. For example, in FIG. 12, it is seen the cap 188 is of a, generally, elliptical configuration having a major axis extending between the arcs 194 and 196 and having a minor axis extending between the flat sides 190 and 192. The cap 188 is disposed across the riser 184, that is, the ends 194 and 196 are at equal distances above the mounting plate 182. In frame 4, see FIGS. 3–6, there is an elongated passageway 332 which has the same general configuration as the cap 188 but is larger in each dimension. The frame 4 is prevented from coming off the stand 180 by a lock plate 200. The lock plate 200 is secured to the frame 4 by a bolt 201 which extends through the hole 203 in the lock plate 200, and is screwed into a tapped hole 205 in the base 324. The lock plate 200 is, generally, triangular in configuration, having two straight sides 202 and 204 joined by a concavely arcuate side 206. The radius of curvature of the arcuate side 206 is larger than the outer radius of the riser 194 by an amount sufficient to provide the clearance 208 indicated in FIG. 16. When the lock plate 200 is assembled to the frame 4, the elongated passageway 332 is still, sufficiently, large to allow the winch 2 to swivel. It can be seen that the winch 2 may also pivot vertically, until either the frame 4, or the lock plate 200, or both, contact the curved ends 194 and 196 of the cap 188. In positioning the frame 4 on the stand 180 the passageway 332 is positioned with the major axis of the passageway 332 aligned with the major axis of the cap 188. Then, after the frame 4 is on the stand 180 the frame is rotated so that the major axis of passageway 332 is, substantially at right angles to the major axis of the cap 188. After the frame 4 is on the stand 180 the lock plate 200 is secured to the base 24 of the frame 4.

Figure 21:
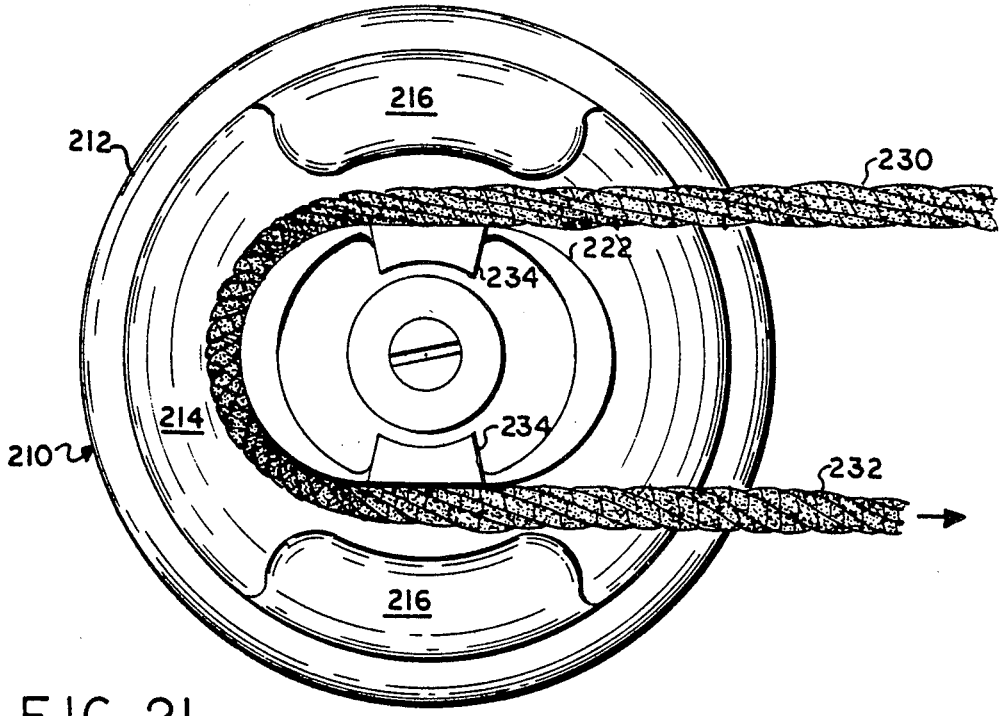
FIG. 21 is a plan view of the cable fastener, and showing a section of cable laid therein.
Figure 22:
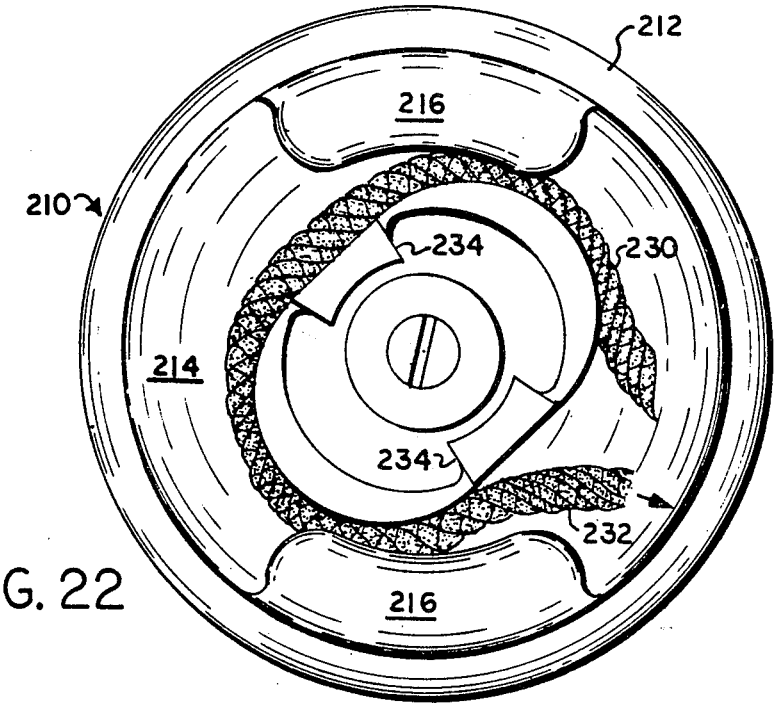
FIG. 22 is a plan view of the cable fastener with the eccentric rotated so as to retain a section of cable against a strain placed on the cable.

A part of the equipment for lashing together barges, in addition to the winch 2, is a cable fastener 210, illustrated in FIGS. 17–22. For each winch 2 used, there is a cable fastener 210, although the cable to be fastened in the fastener 210 may come from any winch on any barge in the train. The cable fastener comprises a stand 212 having a flat tilted top 214. At opposite sides of the top 214 and extending upwardly and inwardly therefrom are lips 216, defining grooves 218. Extending upwardly, perpendicular to the tilted top 214 and in the center thereof is a stud 220. Rotatably mounted on the stud 220 is an eccentric 222. The eccentric 222 has two flat parallel sides 224 and two rounded ends 226. In the periphery of the eccentric 222 there is a groove 228. The groove 228 is in the same plane as the grooves 218 formed by the lips 216. The extreme length of the eccentric 222 between ends 226 is slightly less than the distance between opposite lips 216. Thus, when there is no cable in the grooves, 218 and 228, the eccentric is free to rotate in a full circle between the lips 216. When flat sides 224 are facing the lips 216, the distance between the eccentric 222 and the lips 216 is such that a bight of cable 230 may be placed in the fastener 210 as indicated in FIG. 21. When one end 232 of the cable 230 is pulled, the eccentric 222 will tend to rotate. The cable 230 will, at some points, contact the groove 218 formed by the lips 216 as well as being in contact with the groove 228 in the eccentric 222. If the diameter of the cable 230 is greater than the sum of the depths of the grooves 228 and 218 in the eccentric 222 and a lip 216 plus the minimum clearance between the eccentric 222 and the lip 216, the cable 230 will become pinched between the eccentric 222 and one of the lips 216. The cable 230 will thus be secured to the fastener 210. Any further strain on the cable 230 in the direction indicated by the arrow in FIGS. 21 and 22 will tend only to move the eccentric 222 closer to the lips 216 thus pinching the cable 230 more securely.

It will be noted that a pair of lobes 234 extends upwardly from the upper surface 236 of the eccentric 222. These lobes 234 provide leverage points for a pry bar or similar device which can be used to turn the eccentric 222 in a direction so as to loosen the cable 230 for removing the cable from the fastener 210.

Figure 25:
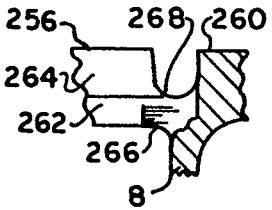
FIG. 25 is a view partially in cross section taken at line 25—25 of FIG. 23.
Figure 23:
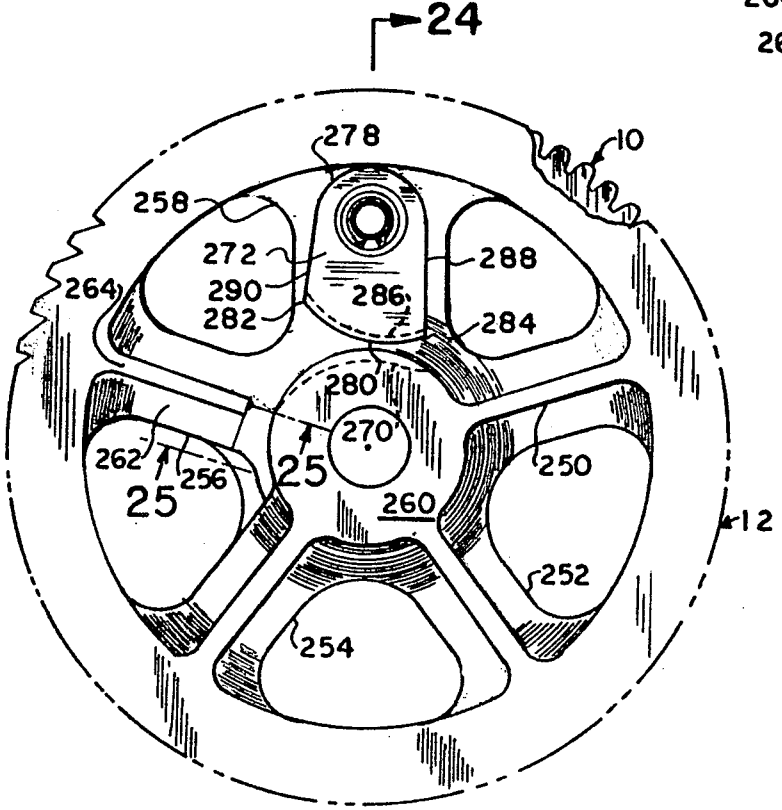
FIG. 23 is a side elevational view of the main ratchet with cable locking pawl, and showing in phantom the grooves for retaining a cable.
Figure 24:
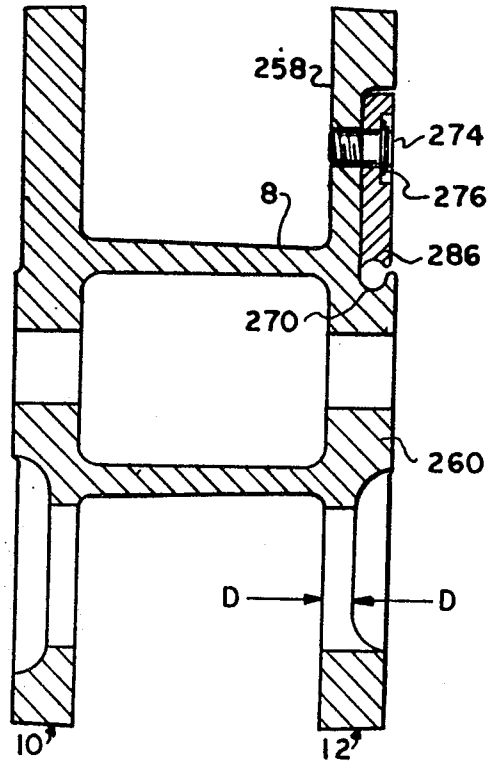
FIG. 24 is a cross-sectional view taken at line 24—24 of FIG. 23.

The preferred method of retaining one end of the cable on drum 8, so that the cable 26 may be further wound thereon, is illustrated in FIGS. 10 and 23–25. The ratchet 12 is supported from drum 8 by four spokes 250, 252, 254 and 256, and a fifth spoke 258 which is wider than any of the other spokes. FIG. 25 illustrates spoke 256, drum 8 and hub 260. Hub 260 is smaller in diameter than drum 8, and is essentially an extension of drum 8, but located outside of the spokes. The spoke 256 comprises a web portion 262 and a rib 264. It is seen in FIG. 25 that, in spoke 256, a groove 266 in web 262 connects with a groove 268 in rib 264. A smooth transition is thus formed, permitting a cable to be passed from drum 8, between spokes 256 and 258, to hub 260. In hub 260 there is a groove 270, beginning at the surface of hub 260 at the point where a cable would emerge from between spokes 256 and 258. The groove 270 becomes deeper as it proceeds in a clockwise direction, and reaches its maximum depth at a point on an imaginary line drawn between the center line of hub 260 and the center of rotation of cable locking pawl 272. Pawl 272 is a flat plate rotatably mounted to spoke 258 by stud 274 and lock ring 276. The pawl 272 has a mounting end 278 and a contact end 280. It is seen that the mounting end 278 of pawl 272 is rounded, so that the pawl 272 can rotate to some extent.

The contact end 280 is arcuate for the greater part of its length between corners 282 and 284. It is seen that corner 282 is nearer the center of rotation of pawl 272 than is corner 284, so that when pawl 272 is rotated counter-clockwise from the position shown in FIG. 23, a relatively large clearance will exist between pawl 272 and hub 260. There is a groove 286 in the contact end 280 of pawl 272. In the position shown in FIGS. 23 and 24, the distance between grooves 286 and 270 is such that a clamping effect can be exerted on a cable of predetermined size laid in the grooves. A small portion of the contact end 280 nearest corner 284 is straight rather than arcuate. The purpose of the straight portion is to exert a wedging effect on a cable laid between grooves 286 and 270. When such a cable is placed between the grooves 286 and 270, the pawl 272 can be locked in place to retain the cable by striking side 288 of pawl 272 with a hammer so as to rotate the pawl 272 in a clockwise direction. A structure has thus been disclosed which can permit a cable to be retained on the winch 2 by passing one end between spokes 256 and 258, and locking it against hub 260 with pawl 272. Obviously, to release the cable, it is only necessary to strike side 290 of pawl 272 with sufficient force to turn pawl 272 in a counter-clockwise direction.

Figure 29:
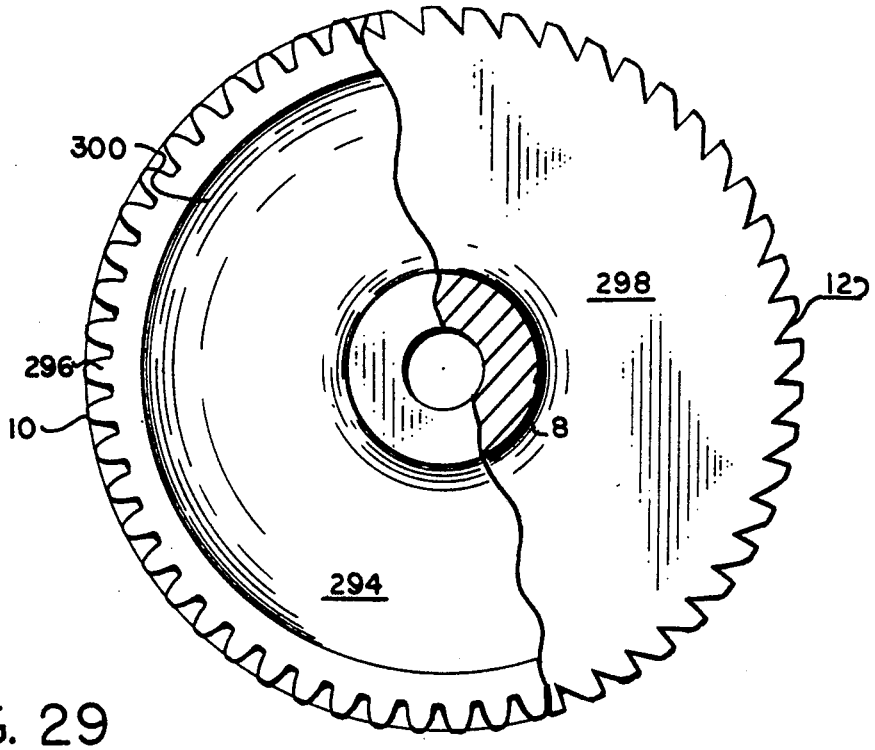
FIG. 29 is a side elevational view of a second embodiment of the gear, drum and ratchet.

It may be thought desirable, for safety reasons, to support ear 10 and ratchet 12 on drum 8 with a solid disc structure rather than spokes. A second embodiment of the gear, ratchet and drum assembly is therefore illustrated in FIGS. 29. There is a disc structure 294 which supports gear rim 296 around drum 8. It is seen that there are no radiating ribs used in this embodiment. The facing side surfaces of the gear 10 and the ratchet 12 are flat as illustrated by surface 298 on the ratchet 12. The outer surface 300 is dished in for its full circumference. The thickness of the disc 294 is approximately that shown between the arrows in line D—D of FIG. 24.

Figure 30:
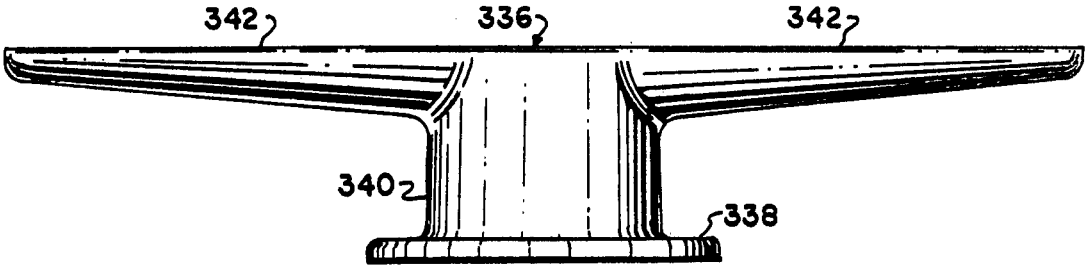
FIG. 30 is a side elevation of a cleat.

The second separately mounted piece of equipment for use with the winch is a cleat 336 illustrated in FIG. 30. The cleat 336 is of the conventional type having a flanged base plate 338 for securing to a deck. A cylindrical stem 340 extends upwardly from the base plate 338 and is surmounted by outwardly extending horns 342.

Figure 31:
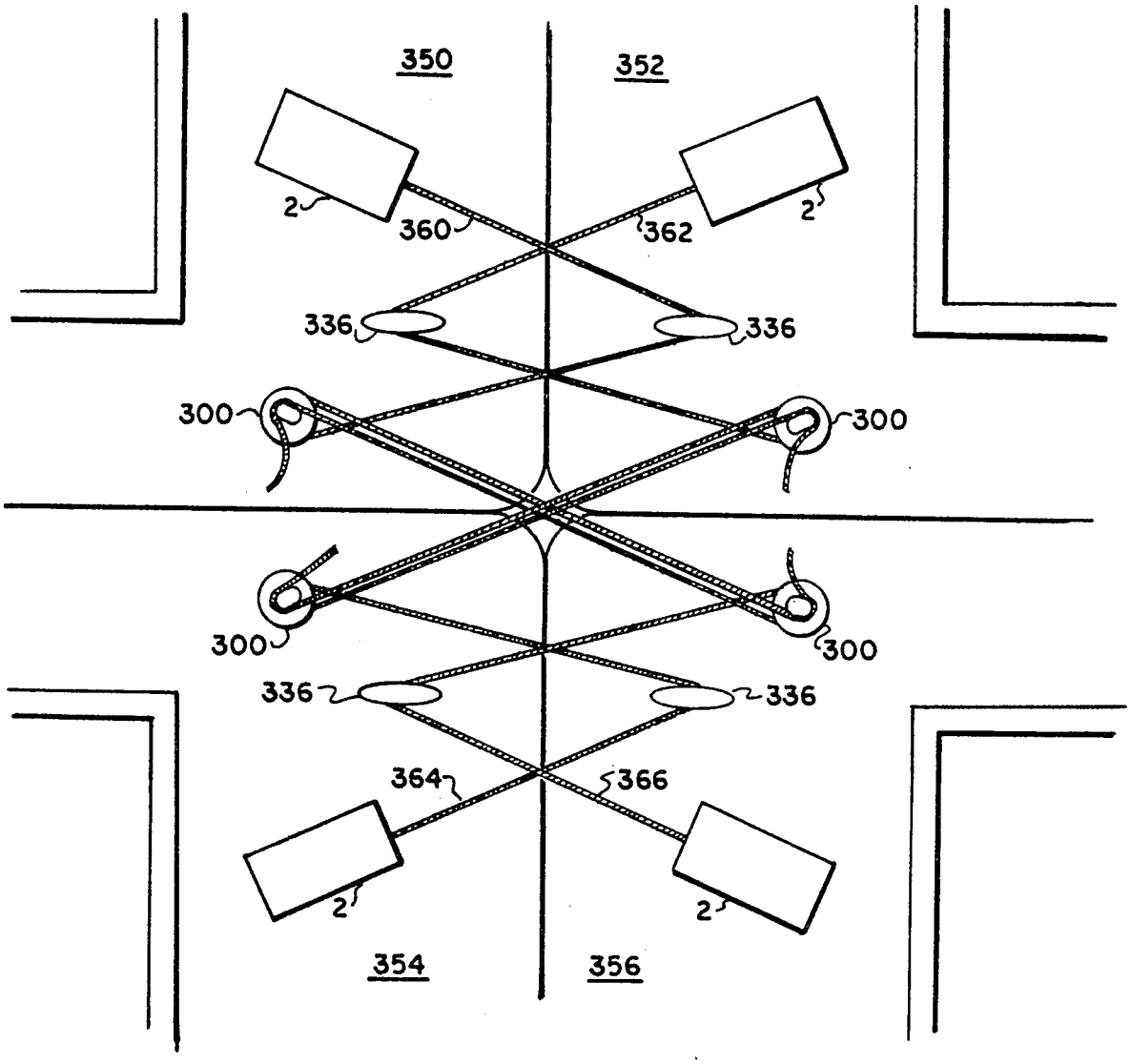
FIG. 31 is a plan view of adjacent corners of four barges lashed together by means of cables, using the winches, cable locking buttons and cleats disclosed herein.
Figure 32:
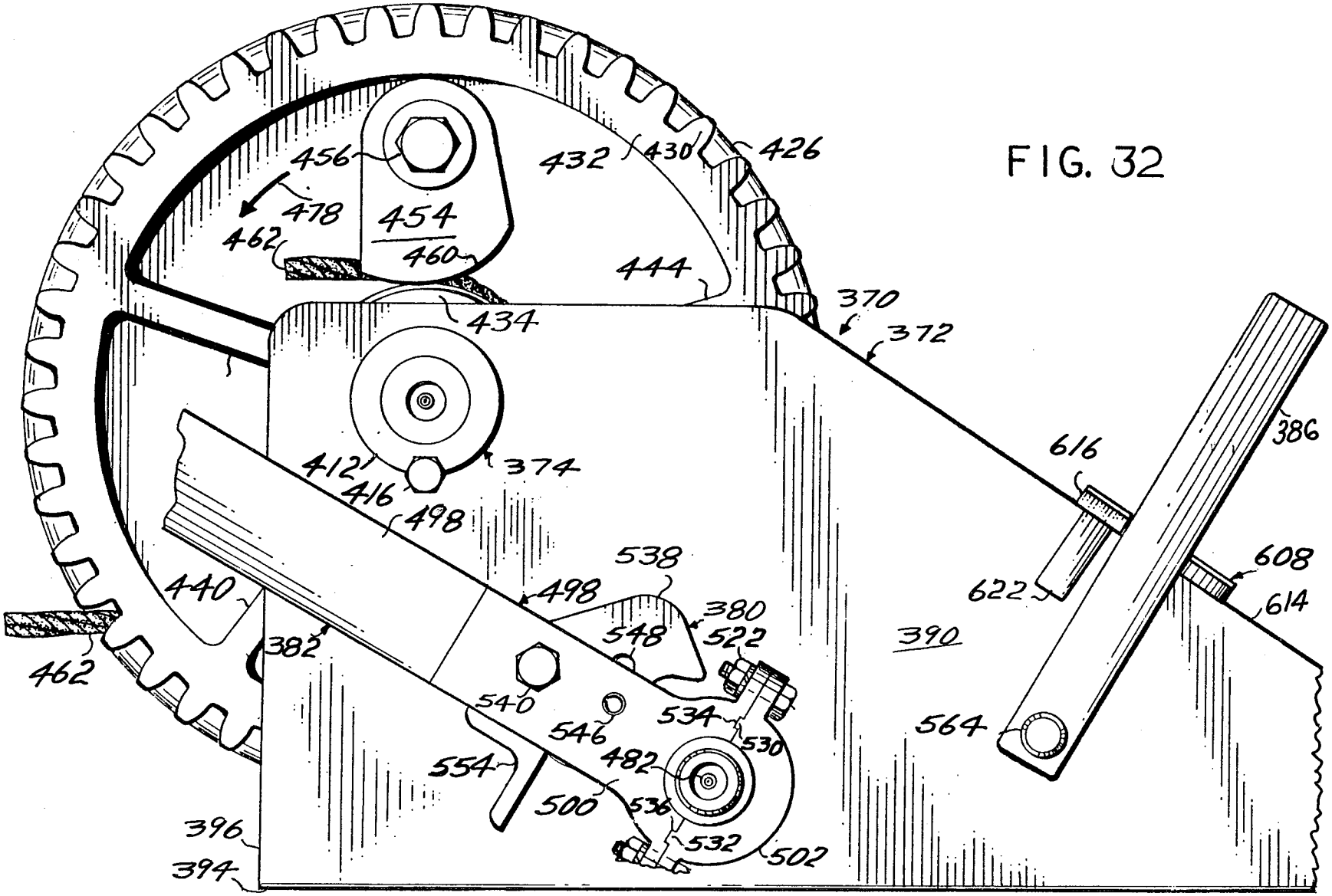
FIG. 32 is a side-elevational view of the winch with the operating handle broken away.
Figure 34:
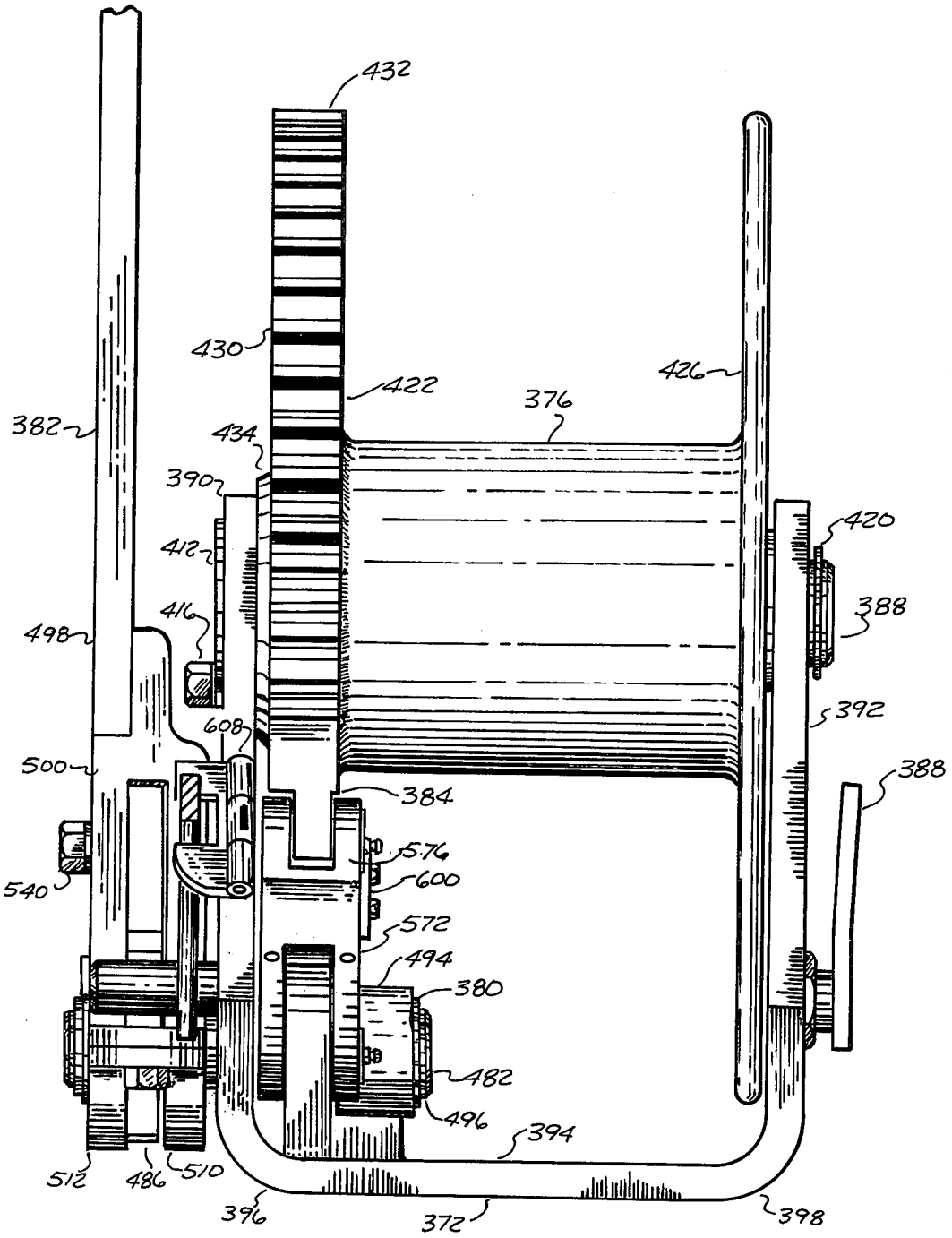
FIG. 34 is end-elevational view of the winch of FIG. 32 looking at the drum and the drum gear.

A method of lashing barges together using the equipment previously described is illustrated in FIG. 31. Each of the four barges 350, 352, 354 and 356 is equipped at each corner with a winch 2, a cable locking burton 300 and a cleat 336. Although many different lashing arrangements may be used, the arrangement of cables should be repetitive so that a deck hand can act quickly to release or to adjust the lashing with respect to a particular barge without having to puzzle out the entire lashing arrangement. In the example shown in FIG. 31, the cable 360 leading from winch 2 on barge 350 is brought around cleat 336 on barge 352. The cable 360 is then wrapped around the pedestal stand of locking button 300 on barge 350, and is then brought across to the eccentric portion of the cable locking button 300 on barge 356, where it is secured. It can be seen that the cable 362 leading from winch 2 on barge 352 is arranged in a similar manner and is finally locked on barge 354. The cables 364 leading from barge 354 and cable 366 leading from barge 356 are similarly arranged. With this arrangement, it can be seen that no two cables will bind against each other in a deck fitting, thus preventing quick release. It can also be seen that no cable is connected to more than two other barges. The winch assembly 370 is illustrated in FIGS. 32, 33, and 34. The winch comprises a unitary frame 372, a shaft 374 fixed to the frame 372, a drum 376 rotating on the shaft 374, a drive mechanism 380 actuated by operating handle 382, a latching mechanism 384 controlled by latching handle 386, and a hand brake 388.

The formation of the unitary frame 372 is the subject of my copending applications, Serial Numbers 251,218 and 589,588.

Figure 35:
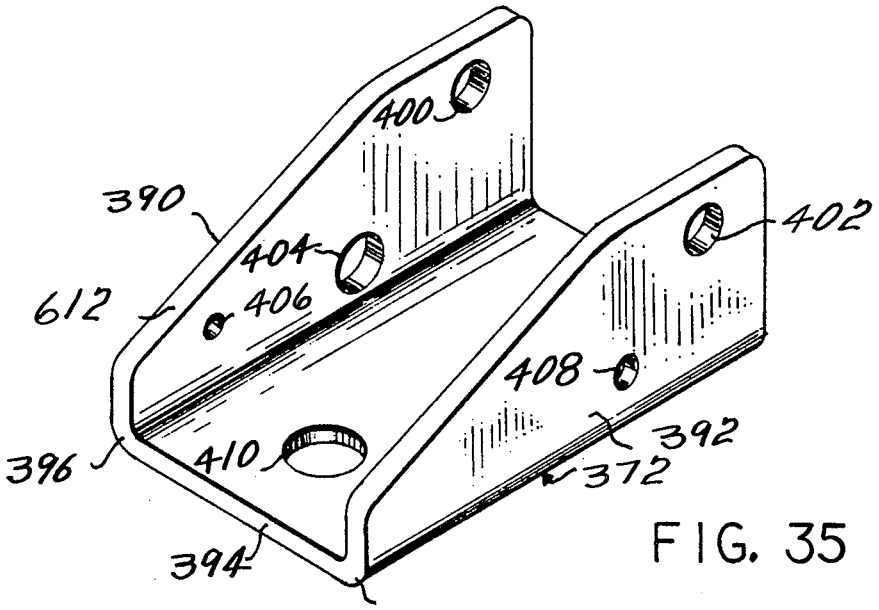
FIG. 35 is a perspective view of the winch unitary frame as finally formed with a base and two spaced apart upright sides for use with the winch of FIG. 32.

The unitary frame 372, which is further illustrated in FIG. 35, comprises a first side 390, a second side 392, and a base 394. The first side 390 is joined to the base 394 by an arcuate first transition 396. The second side 392 is joined to the base 394 by an arcuate second transition 398. The frame 372 is cold formed from a blank, or a flat piece of metal, such as is illustrated in FIG. 3, in which the necessary holes and passageways have already been drilled, cut, or otherwise formed. For example, there is a first drum shaft passageway 400, a second drum shaft passageway 402, a drive shaft passageway 404, a latching shaft passageway 406, a hand brake passageway 408, and a mounting hole 410. The first step in cold forming frame 372 is illustrated in FIG. 4. The frame 4 is bent downwardly along the longitudinal center line passing through the mounting hole 410. Then, as illustrated in FIG. 5, the first side 390 is bent upwardly so as to be perpendicular to the base portion 394. Likewise, the second side 392 is bent upwardly so as to be perpendicular to the base portion 394. In the final step in forming a frame 372, the center line bend, illustrated in FIG. 5 is removed, so that the base 394 is re-bent to form one continuous flat section, as illustrated in FIG. 7. The forming of the frame 372 has, previously, been described with reference to FIGS. 3, 4, and 5.

The shaft 374 is illustrated in FIGS. 37 and 44. One end of the shaft 374 terminates in a flange 40. An arcuate segment is removed from the flange 412 by drilling, thereby defining hole 414. The purpose of the hole 414 is to provide a means to retain the shaft 374 in place both longitudinally and rotationally, with respect to the frame 372, as illustrated in FIG. 32, where a cap screw 416 is shown in a position to retain the shaft 374 in place. At the other end of the shaft 374 as illustrated in FIG. 37, there is a peripheral groove 418, sized to receive snap ring 420, see FIG. 33.

The drum 376 (see FIGS. 39 and 40) is journaled on the shaft 374 and is capable of rotating with respect to the shaft 374. The drum 376 has a first end 422 and a second end 426. The drum 8 is hollow. First end 422 has a centrally located passageway 424, and the second end 426 has a centrally located passageway 428. The passageways 424 and 428 are of a size to rotatably receive the shaft 374. The second end 426 has the shape of a solid disc. The periphery of the first end 422 is defined by spur gear teeth 430 which together make up spur gear 432. The major diameter of spur gear 432 is approximately the same as the outer diameter of the second end 426. This can best be seen in FIGS. 32 and 39. Within the first end 422, there is a centrally located hub 434. A web 436 extends radially outwardly from the hub 434 to the spur gear 432. Ribs 438, 440, 442, and 444 are raised upwardly from the outer surface 446 of web 436. The ribs 438, 440, 442, and 444 connect the hub 434 with the spur gear 432. There is a circular passageway or cable hole 446 extending obliquely through web 436 from the outer surface 446 to the inner surface 448. There is a groove 450 in rib 444, the groove 450 being concentrically in line with the cable hole 446 or opening 446. There is a groove 452 in the hub 434. The cable hole 446 or line hole 446, the groove 450, and the groove 452 have the same radius of curvature. A cable locking pawl 454 is rotatably mounted to the web 436 by means of a bolt 456. A groove 458 is formed in the outer arcuate rim 460 of pawl 454. The groove 458 has the same radius of curvature as the cable hole 446, the groove 450 and the groove 452. The distance between the bottom of the groove 460 and the bottom of the groove 452, when the two are in their closest relationship, is slightly less than the diameter of the cable 462 to be retained on the drum 376. It can be seen, with particular reference to FIG. 32, that the end of a cable 462 passes through cable hole 446 and is laid into grooves 450 and 452 and can be restrained from relative motion with respect to the drum 376 by forcing the pawl 454 into intimate contact with the cable 462.

Lubrication of the interface between the rotating drum 376 and the fixed drum shaft 374 is accomplished by means of suitable grease fittings and passageways, as best illustrated in FIGS. 37 and 38. In the first end 464 of shaft 374, there is a counterbore 466. A zerk fitting 468 is located within the counterbore 466, and is screwed into a longitudinal passageway 470. Longitudinal passageway 470 communicates with radial passageway 472. Similarly, in the second end 474 of shaft 374, there is a counterbore 476. Zerk fitting 468 is located within the counterbore 476, and is screwed into longitudinal passageway 470. Longitudinal passageway 470 communicates with radial passageway 472. When grease is forced into the zerk fitting 468, the grease will flow through passageways 470 and 472, from which it will tend to spread out over that part of the interior cylindrical surface of passageway 424 in hub 434 which is in contact with the shaft 376. Lubrication of the cylindrical interior surface of passageway 428 in the drum 376 is, similarly, accomplished by forcing grease through zerk fitting 468.

The drive mechanism 380 is illustrated in FIGS. 32, 33, and 34 and 41, 42, 43, 44, and 45. The purpose of the drive mechanism is to rotate the winch drum 376 in such a direction as to place tension on a cable or line 462 leading from the winch assembly 370 to the load, which load may be a cleat or other fastening on a barge. The cable 462 is attached to the winch drum as previously described, and leads to the load from the underside of the winch drum 376. When the drum 376 is turned counterclockwise, as indicated by the direction of the arrow 478 in FIG. 32, tension in the cable 462 will tend to increase. The function of the drive mechanism 380 is to drive the winch drum in that direction, and in that direction only. This is accomplished by rocking the operating handle 382 between the position shown in FIG. 43 and the position shown in FIG. 45, or between positions intermediate to those illustrated in FIGS. 43 and 45.

As can best be seen in FIG. 41, a pinion gear 480 is rigidly fixed to drive shaft 482 by means of key 484. Pinion gear 480 cooperates with spur gear 432. A ratchet 486 is rigidly attached to the drive shaft 482 by means of weld 488. There is a bearing carrier 490 having therein a bearing insert 492 which supports and journals the drive shaft 482 between pinion gear 480 and ratchet 486. The bearing carrier 490 is inserted in passageway 404 in side 390 of frame 372, and is rigidly attached to the frame 372 in that position. Additional support for the drive shaft 482 is obtained by means of bearing box 494 having therein a bearing insert 496. Bearing box 494 is rigidly attached to the base 394 of frame 372.

In the ensuing description of the operating mechanism of the winch, it should be borne in mind that the cable which leads from the winch to the load, comes off the bottom of the winch drum, so that if the winch drum 376, as viewed in FIG. 32, turns counterclockwise, and the cable is attached to a load, the tension in the cable will increase. In this specification, the word "winding" means counterclockwise rotation, and the word unwinding means clockwise rotation of the winch, as viewed in FIG. 32.

Referring now to FIG. 42, the operating handle 382 comprises a bar 498, and a split yoke comprising upper element 500 and lower element 502. The bar 498 is rectangular in cross section, and is attached to upper element 500 by welding or other suitable means to provide a rigid attachment. In side elevation, as in FIG. 32, the upper element 500 and the lower element 502 of yoke 504 have, together, the configuration of the lower end of a connecting rod. In an end elevation, however, it is seen that each of the elements 500 and 502 comprises spaced-apart members. The upper element 500 comprises spaced-apart inner member 506 and outer member 508. The lower element 502 comprises spaced apart inner member 510 and outer member 512. The members 510 and 512 are joined by clamping flanges 514 and 516. The upper element members 506 and 508 are joined by clamping flanges 518 and 520.

When the upper element 500 is connected to the lower element 502 by suitable nuts 522 and bolts 524, a first passageway 526, having its center line on the interface of the two elements, is drilled or bored between members 506 and 508. The diameter of the first passageway 526 is such as to provide a rotating clearance with respect to the shaft 482. A second passageway 528 is drilled or bored between members 510 and 512, the diameter of the second passageway 528 being sufficiently large as to make the yoke 504 rotatable with respect to the bearing carrier 488. The first passageway 526 and the second passageway 528 are longitudinally aligned. Tongues 530 and 532 are provided on lower element 502 and cooperating grooves 534 and 536 are provided on upper element 138, to maintain the proper location of upper element 500 with respect to lower element 502, thereby assuring proper size and alignment of passageways 526 and 528.

A drive pawl 538 is rotatably mounted between members 506 and 508 on the operating handle 382 by means of bolt 540 which extends through sleeve 542 in the drive pawl 538. The drive pawl 538 cooperates with ratchet 486.

There is a passageway 544 in member 508 of upper element 500. Roll pin 546 is tightly fitted in passageway 544 and extends outwardly therefrom in the direction of member 506. Roll pin 546 cooperates with slot 548 in drive pawl 538, and with spring 550 in slot 548. It is seen in FIGS. 43, 44, and 46 that the spring 550 acting against roll pin 546 and a first end 552 of slot 548, urges the pawl 538 in a clockwise direction around bolt 540. The pawl 538 thus has a tendency to remain in engagement with ratchet 486, unless forced to turn counterclockwise against the urging of spring 550.

Handle stop 554 projects perpendicularly outwardly from first side 390 of frame 372. The handle stop 554 serves two functions: it limits the rotation of operating handle 382, and it forces pawl 538 out of engagement with ratchet 486 during the extreme leftward portion of the stroke of operating handle 382, as illustrated in FIG. 43. When the pawl 538 is disengaged from ratchet 486, the winch drum 376 is free to rotate in either direction unless locking mechanism 384, to be described below, prevents unwinding of the winch drum 376.

The purpose of the latching or locking mechanism 384 is to prevent the winch drum 376 from turning in an unwinding direction when the operating handle 382 is moving to the left, as viewed in FIG. 32, or is in such a position that the drive pawl 538 is not in engagement with the ratchet 486. Such a position is illustrated, for example, in FIG. 43. The latching mechanism 384 will always, however, allow the winch drum 376 to turn in such a direction as to wind up a cable, or increase the load on a cable.

In FIG. 43, it is seen that the pawl 538 is resting against handle stop 554 and is thus kept out of engagement with ratchet 486. FIG. 44 illustrates a slight clockwise rotation of operating handle 382, permitting pawl 538 to rotate clockwise to a limited degree. It will be recalled that the operating handle 382 is rotatable with respect to shaft 482, so that when operating handle 382 is rotated, and pawl 538 is not engaged with ratchet 486, the ratchet 486 will not be rotated. FIG. 44 illustrates the tendency of pawl 538 to engage ratchet 486 between tooth 560 and tooth 562 of ratchet 486. FIG. 45 illustrates the pawl 538 engaged in ratchet 486 and exerting a force against tooth 562 so as to rotate the ratchet 486 and the shaft 482 to which the ratchet 486 is attached. It is further seen in FIG. 45 that clockwise rotation of operating handle 382 is limited by shaft 564 on which latching handle 386 is mounted. A means is thus disclosed for causing shaft 482 on which a drive pinion (not shown in FIGS. 43, 44, and 45) is mounted to rotate clockwise, thus causing the drum 376 (not shown in FIGS. 43, 44, and 45) to rotate counterclockwise. When the operating handle 382 is rotated from the position of FIG. 45 to the position of FIG. 43, the ratchet 486 will remain stationary under the influence of the latching mechanism 384 to be next described.

The latching mechanism 384 is supported by upright 566 which extends vertically from the base 394 of the frame 372, as illustrated in FIGS. 46 and 47. Upright 566 has a first shoulder 568 and a second shoulder 570. Cam 572, having identical spaced apart legs 574, straddles the first shoulder 568. Cam 572 and latching handle 386 are rigidly attached to shaft 564. The shaft 564 is journaled in the first shoulder 568 and in side 390 of frame 372, the handle 386 is mounted on the shaft 564 outside of frame 372 but at a distance inwardly from the extreme left end of shaft 564 as viewed in FIG. 33. It is seen that this effective outward extension of the shaft 564 serves to limit the arc of rotation of the operating handle 382 at one end of its stroke in a manner similar to that in which the handle stop 554 serves to limit the arc of rotation at the other end of the stroke of operating handle 382.

Referring back now to FIGS. 46 and 47, it is seen that cam 572 cooperates with pawl link 576. Pawl link 576 comprises a central body portion 578 from which extends downwardly a pair of identical spaced apart legs 580, and from which extends upwardly a pair of identical spaced apart legs 582. The downward legs 580 straddle the second shoulder 570 and are rotatably mounted with respect thereto by pin 584. Latching pawl 586 is rotatably mounted between the upward legs 582 of link 578 by means of pin 588. The latching pawl 586 is approximately triangular in shape and comprises a first side 590, a second side 592 and a third side 594. A latching tooth 596 extends outwardly from the first side 590 at its junction with second side 592. The latching tooth 596 is shaped to cooperate with the teeth 430 of the spur gear 432 on drum 376. A rubber block, designated herein as spring 598, occupies the space between the third side 594 of latching pawl 586, and the central body portion 578 and upward legs 582 of pawl link 576.

Under the influence of latching handle 386, the cam 572 can be rotated so as to force the latching tooth 596 of latching pawl 586 into engagement with the teeth of spur gear 432. Overrotation of cam 572 is prevented by lip 598 of cam 572. It can be seen that when the spur gear 432, as viewed in FIG. 46, tends to rotate counterclockwise, an increasingly larger area of the third side 594 of latching pawl 586 will be forced into contact with the rubber spring 598. Clockwise rotation of the latching pawl 586 is thus severely restricted, so that the latching tooth 596 will remain in cooperation with the teeth of spur gear 432 so as to prevent counterclockwise rotation of the spur gear 432. Contrariwise, when the spur gear 432 tends to rotate clockwise, only a small area of the third side 594 of latching pawl 586 is forced into contact with the rubber spring 598. The latching pawl 586 will thus readily rock to permit clockwise rotation of the spur gear 432. It can be seen, therefore, that when the cam 572 is fully engaged with the pawl link 576 so that the lip 598 of cam 572 is in contact with pawl link 576, the spur gear 432 can rotate so as to take a strain on a cable on the winch drum but cannot rotate so as to release the strain. The latching mechanism 384 thus facilitates the operation of the pawl-and-ratchet winch drive mechanism 380.

After a winch has been installed on a barge, and thus exposed to the elements for some period of time, it may develop that the pins 584 and 586 would tend to become "frozen", so that when the cam 572 is rotated out of contact with the pawl link 576, the latching pawl 586 would still remain in engagement with the teeth of spur gear 432 so as to prevent any desired release of tension of a winch cable. The connecting link 600 enables cam 572 to pull the pawl link 576 so as to disengage latching pawl 586 from the spur gear 432. There is a slot 602 in the connecting link 600. The slot 602 cooperates with cap screw 604 on cam 572 and cap screw 606 on pawl link 576. It can be seen that, because of the length of slot 602, the connecting link 600 is inoperative during an engaging motion of cam 572, but can drag the pawl link 576 during a disengaging motion of the cam 572.

A hinged catch 608 prevents inadvertent release of the latching mechanism 384 by holding the latching handle 386 in the latched position illustrated in FIG. 46. The catch 608 comprises a stationary hinge piece 610 containing a hinge pin 612. The stationary hinge piece 610 is rigidly attached to flat upper edge 614 of frame 372. A pivoting hinge piece 616 cooperates with the stationary hinge piece 610 as as to rotate around pin 612. Flat side 618 of the pivoting hinge piece 616 engages with flat upper edge 614 of frame 372, so that the pivoting hinge piece 618 extends outwardly from frame 372 in a plane perpendicular to the plane of rotation of latching handle 386. There is a rectangular notch 620 in the pivoting hinge piece 616, of a size to receive the latching handle 386. A finger 622 depends perpendicularly from the pivoting hinge piece 616. The finger 622 may be used to lift the pivoting hinge piece 616 out of the way of the latching handle 386.

A hand brake 388, illustrated in FIGS. 33, 34, and 36, may be used to retard the speed of the winch 376. The hand brake 388 is used when the winch is unwinding under the influence of tension in the cable 462. The hand brake 624 comprises a cylinder 626 threaded through a nut 628 which is welded onto the outside of side 392 of frame 372 in line with hole 408. The cylinder 626 has a recessed portion into which is cemented a plug 630 of brake lining material. The plug 630 may be moved into contact or out of contact with end 426 of drum 376 by turning handle 632 which is attached to cylinder 626.

It has been stated elsewhere in this application that the winch 370 is intended for use aboard a barge and is used to lash the barge to other barges or to stationary objects. Considering the possible relative motion between two barges or between a barge and a stationary object, it is necessary for the winch to be able to swing horizontally over a wide angle and simultaneously to be able to swing in a vertical arc. A winch stand 634 is provided for this purpose. The winch stand 634 is illustrated in FIGS. 48–51. It comprises a plate 636 which may be welded or otherwise secured to a deck. Extending upwardly from the plate 636 is an elbow 638 comprising a lower vertical portion or lower upright portion 640 from which extends an arcuate portion 642 having an arc of approximately 90°. The arcuate portion 642 terminates in a closed end 644, the orientation of which is approximately perpendicular to the plate 636. The elbow 638 is circular in cross section and has a diameter less less than that of the hole 410 in the frame 372 of the winch 370. There is a counterbored circular cap 646 which is removably attached to the elbow 638 so as to fit over the closed end 644. Attachment of the cap 646 may be by means of the screw 648. To assemble the winch 370 to the stand 634, the cap 646 is removed from the stand 634 and the winch 370 is then passed over the elbow 638 so that the elbow 638 projects through the hole 410 in the winch frame 372. The cap 646 is then assembled to the closed end 644 of the elbow 638. This assembly is illustrated in FIG. 49.

The exterior dimensions of the circular cap 646 are greater than the interior dimensions of the mounting hole 410. After the frame has been moved over the elbow 638 and the circular cap 646 positioned in place by the screw 648, the frame cannot be moved off elbow 638 or the winch stand 636. The cap 646 may be considered to be a locking member for locking the frame onto the winch stand 636.

A method of lashing barges together using the equipment, previously, described is illustrated in FIG. 31. Each of the four barges 350, 352, 354 and 356 is equipped at each corner with a winch, such as winch assembly 370, a cable locking button 300 and a cleat 336. As, previously, stated, many different lashing arrangements may be used, the arrangement of cables should be repetitive so that a deck hand can act quickly to release or to adjust the lashing with respect to a particular barge without having to puzzle out the entire lashing arrangement. In the example shown in FIG. 28, the cable 360 leading from winch assembly 370 on barge 350 is brought around cleat 336 on barge 352. The cable 360 is then wrapped around the pedestal stand of locking button 300 on barge 350, and is then brought across to the eccentric portion of the cable locking button 300 on barge 356, where it is secured. It can be seen that the cable 362 leading from winch 2 on barge 352 is arranged in a similar manner and is finally locked on barge 352. The cables 364 leading from barge 354 and cable 366 leading from barge 356 are similarly arranged. With this arrangement, it can be seen that no two cables will bind against each other in a deck fitting, thus preventing quick release. It can also be seen that no cable is connected to more than two other barges.

It should be understood that the word "cable" as used in this specification and in the claims includes cable or rope or line made of natural or synthetic fibers as well as various kinds of metal, because the apparatus described herein is capable of functioning properly with those forms of cable or rope or line.

From the foregoing presentation of my invention, what I claim is:

1. A winch for receiving a line, said winch comprising:

a. a frame comprising a first support and a second support;
b. said first support and said second support being spaced apart;
c. a drum around which said line may be wound;
d. said drum being positioned between said first support and said second support;
e. a first means for rotating said drum for winding said line onto said drum;
f. a drum gear on said drum and connecting with said first means comprising said drum;
g. said first means comprising a drive pinion operatively connecting with said drum gear;
h. a second means for rotating said drive pinion for rotating said drum gear and said drum;
i. said drum gear being mounted on said drum and defining a barrier for said line to position said line on said drum;
j. said frame being a unitary frame having a base and two spaced apart upright sides and being of metal plate at least about three-sixteeth inch thick;
k. a passageway in said base;
l. a stand having a base for attaching to a support structure such as a deck;
m. said stand comprising a riser;
n. the interior dimensions of said passageway being greater than the exterior dimensions of said riser so that said frame may pass over said riser and move on said riser;
o. a cap on top of said riser;
p. said cap being of a generally, elliptical configuration having a major axis of a greater dimension than the dimension of said riser; and,
q. said passageway being of a, generally, elliptical configuration, and having dimensions greater than the dimensions of said cap so that said frame may pass over said cap.

2. A winch according to claim 1 and comprising:

a. said riser bending upon rising from said base;
b. a locking plate;
c. means to attach the locking plate to the frame; and,
d. part of said locking plate covering part of said passageway to prevent said frame passing over said cap.

3. A winch for receiving a line, said winch comprising:

a. a frame comprising a first support and a second support;
b. said first support and said second support being spaced apart;
c. a drum around which said line may be wound;
d. said drum being positioned between said first support and said second support;
e. a first means for rotating said drum for winding said line onto said drum;
f. a drum gear on said drum and connecting with said first means comprising said drum;
g. said first means comprising a drive pinion operatively connecting with said drum gear;
h. a second means for rotating said drive pinion for rotating said drum gear and said drum;

i. said drum gear being mounted on said drum and defining a barrier for said line to position said line on said drum;
j. said drum having a hub;
k. a means cooperating with said hub to firmly position said line;
l. said means comprising a rotating pawl having an end juxtapositioned to said hub;
m. the spacing between said hub and said rotating pawl being sufficient to receive said line;
n. said hub being recessed to receive said line;
o. said rotating pawl having a curved recessed end juxtapositioned to said hub; and,
p. laid line upon being positioned between said hub and said curved recessed end and under tension rotating said rotating pawl to clamp said line in position.

4. A winch for receiving a line, said winch comprising:
a. drum for receiving said line;
b. a frame having a base;
c. a passageway in said base;
d. a stand having a base for attaching to a support structure such as a deck;
e. said stand comprising a riser;
f. the interior dimensions of said passageway being greater than the exterior dimensions of said riser so that said frame may pass over said riser to be free to move along said riser and to rotate around said riser;
g. a cap on top of said riser;
h. said cap being of a, generally, elliptical configuration having a major axis of a greater dimenson than the dimension of said riser; and,
i. said passageway being of a, generally, elliptical configuration and having dimensions greater than the dimensions of said cap so that said frame may pass over said cap.

5. A winch according to claim 4 and comprising:
a. said riser bending upon rising from said base;
b. a locking plate;
c. means to attach the locking plate to the frame; and,
d. part of said locking plate covering part of said passageway to prevent said frame passing over said cap.

6. A winch for receiving a line, said winch comprising:
a. a drum for receiving said line;
b. said drum having a hub;
c. a means cooperating with said hub to firmly position said line;
d. said means comprising a rotating pawl having an end juxtapositioned to said hub;
e. the spacing between said hub and said rotating pawl being sufficient to receive said line;
f. said hub being recessed to receive said line;
g. said rotating pawl having a curved recessed end juxtapositioned to said hub; and,
h. said line upon being positioned between said hub and said curved recessed end and under tension rotating said rotating pawl to clamp said line in position.

7. A winch for receiving a line, said winch comprising:
a. a frame comprising a first support and a second support;
b. said first support and said second support being spaced apart;
c. a drum around which said line may be wound;
d. said drum being positioned first support and said second support;
e. a first means for rotating said drum for winding said line onto said drum;
f. a drum gear on said drum and connecting with said first means comprising said drum;
g. said first means comprising a drive pinion operatively connecting with said drum gear;
h. a second means for rotating said drive pinion for rotating said drum gear and said drum;
i. said drum gear being mounted on said drum and defining a barrier for said line to position said line on said drum;
j. a locking mechanism for preventing rotation of the drum;
k. said locking mechanism comprising a drum ratchet on said drum;
l. a first detent pawl operatively engaging said drum ratchet;
m. said drum gear and said drum ratcher being spaced apart on said drum to define barriers for said line to position said line on said drum;
n. a support connecting with said frame;
o. a pawl link mounted on said support;
p. said first detent pawl mounted on said support;
q. said support allowing relative movement between said first detent pawl and said pawl link;
r. said support being an inboard support operatively mounted on said frame;
s. a third means for mounting said pawl link on said inboard support; and,
t. said first detent pawl being mounted on said pawl link.

8. A winch according to claim 7 and comprising:
a. said third means allowing relative movement between said inboard support and said pawl link.

9. A winch according to claim 8 and comprising:
a. a cam operatively connecting with said pawl link; and,
b. means to move said cam with respect to said pawl link.

10. A winch according to claim 8 and comprising:
a. a cam operatively connecting with said pawl link; and,
b. a means for rotating said cam for engagement with said pawl link.

11. A winch according to claim 10 and comprising:
a. a plate mounted on said frame; and,
b. said plate operatively engaging said means for rotating said cam to restrict the movement of said means.

12. A winch according to claim 7 and comprising:
a. said frame being a unitary frame having a base and two spaced apart upright sides and being of metal plate at least about three-sixteeth inch thick.

13. A winch according to claim 12, said winch comprising:
a. said frame being a unitary frame.

14. A winch according to claim 7 and comprising:
a. a passageway in said base;
b. a stand having a base for attaching to a support structure such as a deck;
c. said stand comprising a riser; and,
d. the interior dimensions of said passageway being greater than the exterior dimensions of said riser so that said frame may pass over said riser and move on said riser.

15. A winch for receiving line, said winch comprising:
a. a frame comprising a base and two spaced apart upright sides;
b. a first shaft extending between and supported by said two sides;
c. a rotatable drum mounted on said first shaft;
d. said drum comprising a drum gear juxtapositioned to a first side of said two spaced apart upright sides;
e. a drive pinion operatively connecting with said drum gear;
f. a drive means for driving said drive pinion for rotating said drum gear and said drum;
g. a latching means for contacting said drum gear to prevent rotation of said drum gear and said drum;
h. a bearing carrier connecting with said base and juxtapositioned to said first side;
i. a passageway in said first side;
j. a second shaft supported by said bearing carrier and said first side and extending through said passageway;
k. said drive pinion being mounted on said second shaft;
l. said drive means connecting with said second shaft;
m. said drive means comprising a ratchet positioned on the second shaft;
n. a handle rotatably mounted on said second shaft;
o. a drive pawl operatively associated with said handle and in a driving relationship to said ratchet;
p. in operation said drive pawl engaging said ratchet and with the rotation of said handle said drive pawl rotating said ratchet and said second shaft and said drive pinion and said drum gear and said drum;
q. said latching means comprising a latching pawl for engaging said drum gear to prevent rotation of said drum gear and said drum and the unwinding of the line;
r. an upright connecting with said base;
s. said latching means being mounted on said upright and being supported by said upright;
t. a cam operatively connecting with said pawl link;
u. means to move said cam with respect to said pawl link;
v. a latching handle;
w. a means connecting said latching handle and said cam for movement of the cam with movement of the latching handle.
x. a third shaft;
y. said pawl link being mounted on said third shaft;
z. said third shaft and said pawl link being movable with respect to each other;
aa. a locking means operatively connecting with said latching means to prevent the rotation of said cam; and,
bb. said cam upon being rotated away from said pawl link allowing said pawl link and said latching pawl to move relative to each other, and to allow said latching pawl to disengage from said drum gear to allow said drum to rotate to unwind said line.

16. A winch according to claim 15, said winch comprising:
a. said frame being a unitary frame;
b. said base being flat for contacting a deck; and,
c. said sides being flat.

17. A winch according to claim 15, said winch comprising:
a. a pawl link;
b. a first means connecting said latching pawl and a pawl link; and,
c. said latching pawl and said pawl link being movable relative to each other around said first means.

18. A winch according to claim 17, said winch comprising:
a. a resilient means operatively positioned with respect to said pawl link and said latching pawl to restrict relative movement between said pawl link and said latching pawl.

19. A winch according to claim 15, said winch comprising:
a. an upright member; and,
b. said frame having an attaching means for joining together said upright member and said frame to allow said frame to move along said upright member and to move around said upright member.

20. A winch according to claim 19, said winch comprising:
a. a locking means for locking together said upright member and said frame.

21. A winch according to claim 15, said winch comprising:
a. a winch stand comprising a base for securing to a deck;
b. an upright member secured to the base of said winch stand;
c. the base of said frame comprising a mounting hole; and,
d. the interior dimensions of said mounting hole being greater than the exterior dimensions of said upright member and to allow said frame to move along said upright member and to move around said upright member.

22. A winch according to claim 21, said winch comprising:
a. said upright member bending into an elbow; and,
b. a locking member for attaching to said upright for preventing said frame moving off said winch stand.

23. A winch according to claim 15, said winch comprising:
a. said drum gear having a hub;
b. a means cooperating with said hub to firmly position a line;
c. said means comprising a rotating pawl having an end juxtapositioned to said hub; and,
d. the spacing between said hub and said rotating pawl being sufficient to receive said line.

24. A winch according to claim 23, said winch comprising:
a. said hub being recessed to receive said line;
b. said rotating pawl having a curved recessed end juxtapositioned to said hub; and,
c. said line being positioned between said hub and said curved recessed end and under tension rotating said rotating pawl to clamp said line in position.

25. A winch for receiving a line, said winch comprising:
a. a frame comprising a base and two spaced apart upright sides;
b. a first shaft extending between and supported by said two sides;
c. a rotatable drum mounted on said first shaft;
d. said drum comprising a drum gear juxtapositioned to a first side of said two spaced apart upright sides;
e. a latching means for contacting said drum gear to prevent rotation of said drum gear and said drum;
f. an upright support connecting with said base;

g. said latching means connecting with and being supported by said upright support;

h. said latching means comprising a latching pawl for engaging said drum gear to prevent rotation of said drum gear and said drum and the unwinding of the line;

i. a pawl link;

j. a first means connecting said latching pawl and a pawl link;

k. said latching pawl and said pawl link being movable relative to each other around said first means;

l. a cam operatively connecting with said pawl link;

m. means to move said cam with respect to said pawl link;

n. a latching handle;

o. a means connecting said latching handle and said cam for movement of the cam with movement of the latching handle;

p. a second shaft;

q. said pawl link being mounted on said second shaft;

r. said second shaft and said pawl link being movable with respect to each other; and, s. said cam upon being rotated away from said pawl link allowing said pawl link and said latching pawl to move relative to each other, and to allow said latching pawl to disengage from said drum gear to allow said cam to rotate and unwind said line.

26. A winch according to claim 25, said winch comprising:

a. said frame being a unitary frame.

* * * * *